US011191685B2

(12) United States Patent
Mulhern et al.

(10) Patent No.: US 11,191,685 B2
(45) Date of Patent: Dec. 7, 2021

(54) ADJUSTABLE HEIGHT WHEELCHAIR

(71) Applicant: Pride Mobility Products Corporation, Exeter, PA (US)

(72) Inventors: James Mulhern, Nanticoke, PA (US); Stephen J. Antonishak, Nanticoke, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 39 days.

(21) Appl. No.: 16/098,905

(22) PCT Filed: Feb. 27, 2017

(86) PCT No.: PCT/US2017/019645

§ 371 (c)(1),
(2) Date: Nov. 5, 2018

(87) PCT Pub. No.: WO2017/147569

PCT Pub. Date: Aug. 31, 2017

(65) Prior Publication Data

US 2019/0192362 A1 Jun. 27, 2019

Related U.S. Application Data

(60) Provisional application No. 62/300,828, filed on Feb. 27, 2016, provisional application No. 62/301,357, filed on Feb. 29, 2016.

(51) Int. Cl.
*A61G 5/10* (2006.01)
*A61G 5/04* (2013.01)

(52) U.S. Cl.
CPC ..... *A61G 5/1059* (2013.01); *A61G 5/04* (2013.01); *A61G 5/043* (2013.01); *A61G 5/1078* (2016.11); *A61G 2203/30* (2013.01)

(58) Field of Classification Search
CPC ..... A61G 5/1059; A61G 5/043; A61G 5/04; A61G 5/1078; A61G 5/1089; A61G 2203/30
See application file for complete search history.

(56) References Cited

U.S. PATENT DOCUMENTS 2,586,273 A 2/1952 Steven
3,375,105 A 3/1968 Lynch
(Continued)

FOREIGN PATENT DOCUMENTS

CA 2254372 A1 5/2000
CN 1548020 A 11/2004
(Continued)

OTHER PUBLICATIONS

International Search Report and Written Opinion of the International Searching Authority, dated May 18, 2017, for International Application No. PCT/US2017/019645.
(Continued)

*Primary Examiner* — Frank B Vanaman
(74) *Attorney, Agent, or Firm* — Morgan, Lewis & Bockius LLP

(57) ABSTRACT

A powered wheelchair comprises a frame and an arm assembly that includes an arm that is pivotably coupled to the frame. The arm assembly includes a wheel coupled to the arm. A drive system is coupled to the arm assembly and configured to drive a drive wheel. An arm limiter is pivotably coupled to the suspension and coupled to one or more of the arm assembly and the drive system in an engaged position. The arm limiter is configured to limit movement of the arm assembly in the engaged position.

24 Claims, 13 Drawing Sheets

(56) References Cited

U.S. PATENT DOCUMENTS 3,848,883 A 11/1974 Breacain
3,964,725 A 6/1976 Matsui et al.
4,842,233 A 6/1989 Rusin
5,108,493 A 4/1992 Causton
5,137,295 A 8/1992 Peek
5,209,322 A 5/1993 McMahon
5,409,250 A * 4/1995 Csotonyi ..... A61G 5/042 180/6.2
5,435,404 A 7/1995 Garin, III
5,601,302 A * 2/1997 Beard ..... A61G 5/1059 280/250.1
5,762,155 A 6/1998 Scheulderman
5,772,237 A 6/1998 Finch et al.
5,904,214 A 5/1999 Lin
5,964,473 A * 10/1999 Degonda ..... A61G 5/043 180/907
6,047,979 A 4/2000 Kraft et al.
6,070,898 A 6/2000 Dickie et al.
6,129,165 A 10/2000 Schaffner et al.
6,135,222 A * 10/2000 Furukawa ..... A61G 5/043 180/11
6,142,568 A 11/2000 Abelbeck et al.
6,202,773 B1 3/2001 Richey, II et al.
6,234,507 B1 5/2001 Dickie et al.
6,241,391 B1 6/2001 Hoose
6,357,793 B1 * 3/2002 Dickie ..... A61G 5/10 16/20
6,454,286 B1 9/2002 Hosino
6,460,641 B1 10/2002 Kral
6,484,829 B1 11/2002 Cox
6,494,474 B1 12/2002 Kramer, Jr.
6,540,250 B1 4/2003 Peterson
6,554,086 B1 4/2003 Goertzen
6,615,937 B2 9/2003 Richey, II et al.
6,776,430 B2 8/2004 White
6,851,711 B2 2/2005 Goertzen et al.
6,923,278 B2 8/2005 Mulhern et al.
6,938,923 B2 9/2005 Mulhern et al.
7,003,381 B2 2/2006 Wakefield, II
7,040,429 B2 5/2006 Molnar
7,083,195 B2 8/2006 Goertzen et al.
7,090,241 B2 8/2006 Silva
7,104,346 B2 9/2006 Schaffner
7,150,463 B1 12/2006 Liao
7,219,924 B2 5/2007 Mulhern et al.
7,232,008 B2 6/2007 Levi
7,264,272 B2 9/2007 Mulhern et al.
7,293,801 B2 11/2007 Bertrand et al.
7,306,247 B2 12/2007 Wu
7,311,329 B2 12/2007 Mulhern et al.
7,314,220 B2 1/2008 Turturiello et al.
7,316,282 B2 1/2008 Mulhern et al.
7,344,155 B2 3/2008 Mulhern et al.
7,370,876 B2 5/2008 Hsu et al.
7,374,002 B2 5/2008 Fought
7,380,824 B2 6/2008 Chen et al.
7,389,835 B2 6/2008 Mulhern et al.
7,413,038 B2 8/2008 Mulhern et al.
7,419,176 B2 9/2008 Perk
7,516,984 B2 4/2009 Tang
7,556,109 B2 7/2009 Chen et al.
7,694,990 B2 4/2010 Goertzen et al.
7,708,093 B1 5/2010 Baker
7,726,689 B2 6/2010 Mulhern et al.
7,735,591 B2 6/2010 Grymko et al.
7,748,490 B2 7/2010 Hornick
7,766,106 B2 8/2010 Puskar-Pasewicz
7,766,342 B2 8/2010 Fast et al.
7,896,394 B2 3/2011 Jackson et al.
7,921,954 B2 4/2011 Johnson et al.
7,931,300 B2 4/2011 Mulhern et al.
7,942,445 B2 5/2011 Kramer, Jr. et al.
8,050,820 B2 11/2011 Yanaka et al.
8,078,365 B2 12/2011 Emilsson
8,113,531 B2 2/2012 Zhou et al.
8,118,321 B2 2/2012 Hunziker et al.
8,172,015 B2 5/2012 Molnar
8,181,992 B2 5/2012 Mulhern et al.
8,272,461 B2 9/2012 Bekoscke et al.
8,297,388 B2 10/2012 Lindenkamp et al.
8,362,872 B2 1/2013 Clapperton
8,408,343 B2 4/2013 Puskar-Pasewicz
8,408,598 B2 4/2013 Mulhern et al.
8,534,679 B2 9/2013 Goertzen et al.
8,556,347 B2 10/2013 Lin
8,573,341 B2 11/2013 Fought
8,616,309 B2 12/2013 Art et al.
8,794,359 B2 8/2014 Bekoscke et al.
8,833,774 B2 9/2014 Goertzen et al.
8,851,214 B2 10/2014 Mirzaie
8,910,975 B2 12/2014 Bekoscke et al.
8,925,943 B2 1/2015 Molnar
9,010,470 B2 4/2015 Cuson
9,033,360 B2 5/2015 Davis
9,301,894 B2 4/2016 Mulhern
9,308,143 B2 4/2016 Bekoscke et al.
9,320,661 B2 4/2016 Mirzaie
9,333,132 B2 5/2016 Bruestle et al.
9,346,335 B2 5/2016 Bekoscke et al.
9,351,889 B2 5/2016 Mulhern et al.
9,358,165 B2 6/2016 Wu
9,364,377 B2 6/2016 Goertzen et al.
9,370,455 B2 6/2016 Molnar
9,474,664 B2 10/2016 Mulhern et al.
9,566,200 B2 2/2017 Mulhern et al.
9,700,470 B2 7/2017 Bekoscke et al.
9,808,383 B2 11/2017 Mulhern et al.
10,130,532 B2 11/2018 Mulhern et al.
10,687,997 B2 6/2020 Mulhern et al.
2002/0149168 A1 10/2002 Brown
2003/0205420 A1 11/2003 Mulhern et al.
2004/0032119 A1 2/2004 Tran et al.
2004/0168839 A1 * 9/2004 Wu ..... A61G 5/043 180/65.1
2004/0262859 A1 12/2004 Turturiello
2005/0046129 A1 3/2005 Antonishak et al.
2005/0077715 A1 4/2005 Mulhern et al.
2005/0206124 A1 9/2005 Levi et al.
2006/0022445 A1 2/2006 Mulhern
2006/0076747 A1 4/2006 Pauls et al.
2006/0076748 A1 4/2006 Pauls et al.
2006/0087166 A1 4/2006 Trippensee et al.
2006/0097478 A1 * 5/2006 Goertzen ..... A61G 5/02 280/304.1
2006/0120837 A1 6/2006 Hung et al.
2006/0201723 A1 9/2006 Hsu et al.
2007/0084648 A1 4/2007 DuFresne
2007/0208483 A1 9/2007 Rabin
2007/0278761 A1 12/2007 Firth
2008/0106060 A1 5/2008 Knopf
2008/0133089 A1 6/2008 Bayomy
2008/0157513 A1 7/2008 Cheng
2008/0265541 A1 10/2008 Mulhern et al.
2009/0145677 A1 6/2009 Zhou et al.
2009/0257855 A1 10/2009 Iannelli
2010/0004820 A1 1/2010 Bekoscke et al.
2010/0219623 A1 9/2010 Mulhern et al.
2010/0327557 A1 * 12/2010 Wang ..... A61G 5/045 280/304.1
2011/0083913 A1 4/2011 Cuson et al.
2011/0108348 A1 5/2011 Mulhern et al.
2012/0143400 A1 6/2012 Hinkel, III
2012/0217081 A1 8/2012 Mulhern et al.
2013/0111660 A1 5/2013 Wilson
2013/0207364 A1 8/2013 Bekoscke et al.
2013/0220717 A1 8/2013 Mulhern et al.
2013/0253769 A1 9/2013 Kamo et al.
2013/0306383 A1 11/2013 Mulhern et al.
2014/0019011 A1 1/2014 Lofstrand
2014/0262566 A1 9/2014 Grant et al.
2015/0015043 A1 1/2015 Jahkel et al.
2015/0173985 A1 6/2015 Mulhern et al.
2015/0196438 A1 7/2015 Mulhern et al.

(56) References Cited

U.S. PATENT DOCUMENTS

| | | | |
|---|---|---|---|
| 2015/0196441 | A1 | 7/2015 | Mulhern et al. |
| 2015/0202102 | A1 | 7/2015 | Dunham |
| 2015/0283010 | A1 | 10/2015 | Cuson et al. |
| 2016/0120715 | A1 | 5/2016 | Farmer |
| 2016/0228311 | A1 | 8/2016 | Mulhern et al. |
| 2016/0287456 | A1 | 10/2016 | Bekoscke et al. |
| 2017/0156952 | A1 | 6/2017 | Mulhern et al. |
| 2018/0028379 | A1 | 2/2018 | Bekoscke et al. |
| 2020/0276065 | A1 | 9/2020 | Mulhern et al. |

FOREIGN PATENT DOCUMENTS

| | | | |
|---|---|---|---|
| CN | 103169579 | A | 6/2013 |
| CN | 103230319 | A | 8/2013 |
| CN | 104203186 | A | 12/2014 |
| CN | 204016663 | U | 12/2014 |
| EP | 1522295 | A2 | 4/2005 |
| EP | 1523971 | A1 | 4/2005 |
| EP | 2082796 | | 9/2005 |
| EP | 1839637 | | 3/2006 |
| EP | 2082705 | | 1/2009 |
| JP | 08238274 | A | 9/1996 |
| JP | 11188064 | A | 7/1999 |
| JP | 2001-104391 | | 4/2001 |
| WO | 1990/006097 | | 6/1990 |
| WO | 20001021478 | | 4/2000 |
| WO | 2002034190 | | 5/2002 |
| WO | 03101364 | A2 | 12/2003 |
| WO | 2010056193 | A1 | 5/2010 |
| WO | 2011077639 | | 6/2011 |
| WO | 2013123398 | | 8/2013 |
| WO | 2014143642 | A1 | 9/2014 |
| WO | 2015095156 | A1 | 6/2015 |
| WO | 2015095221 | A2 | 6/2015 |
| WO | 2016041087 | A1 | 3/2016 |

OTHER PUBLICATIONS

European Search Report dated Feb. 13, 2020 for European Patent Application No. 17757411.8, 7 pages.

First Office Action for Chinese Patent Application No. 201780013055.8 dated Apr. 30, 2019, 7 pages.

Office Action for Canadian Patent Application No. 3013227 dated Jul. 4, 2019, 4 pages.

Examination Report No. 1 for Australian Patent Application No. 2017224130 dated Aug. 13, 2019, 3 pages.

2nd Chinese Office Action for Chinese Patent Application No. 201780013055.8 dated Sep. 25, 2019, 5 pages.

Canadian Office Action dated Apr. 22, 2020 for Canadian Patent Application No. 3,013,227, 4 pages.

Jazzy 600 ES Owner's Manual, Pride Mobility Products Corporation, INFMANU4480/Rev B/Jun. 2013, pp. 1-32.

http://www.sunparts.us/partscatalog/print/completepartsmanual_quickie_s646s646ses626,pdf, Oct. 2017.

Sunrise Medical, S626 Smart Seat Owners Manual.

S626 Rear Caster Arm Lock-out; https://www.quickie-wheelchairs.com/replacement-parts/sunrise-medical/quickie-s646-s646se-s636-s626/base/anti-tip/anti-tip-componets.

S646 Anti-tip Lockout Mechanism; https://www.quickie-wheelchairs.com/replacement-parts/sunrise-medical/quickie-s646-s646se-s636-s626/base/anti-tip/anti-tip-lock-out-mechanism.

* cited by examiner

ADJUSTABLE HEIGHT WHEELCHAIR

CROSS-REFERENCE TO RELATED APPLICATIONS

This application is a U.S. national stage of International Application No. PCT/US2017/019645, filed Feb. 27, 2017, which claims the benefit of U.S. Provisional Patent Application No. 62/300,828 filed Feb. 27, 2016 and entitled "Adjustable Height Wheelchair" and U.S. Provisional Patent Application No. 62/301,357 filed Feb. 29, 2016 and entitled "Adjustable Height Wheelchair", which are each incorporated by reference herein in its entirety.

FIELD OF THE INVENTION

The present invention generally relates to an adjustable height wheelchair and, more particularly, to a powered wheelchair that elevates from a lowered position to a raised position.

BACKGROUND

Wheelchairs are an important means of transportation for a significant portion of society and provide an important degree of independence for those they assist. However, this degree of independence can be limited if the wheelchair is required to traverse obstacles such as, for example, curbs that are commonly present at sidewalks and other paved surface interfaces, and door thresholds. Accordingly, powered wheelchairs have been the subject of increasing development efforts to provide handicapped and disabled persons with independent mobility to assist them in leading active lives.

To aid in climbing curbs, some power wheelchairs typically have a pair of forward extending anti-tip assemblies that are rotatably coupled to the wheelchair frame. The arms of the anti-tip assemblies are rotatably coupled to the wheelchair frame such that when the wheelchair encounters a curb, the anti-tip assemblies will pivot upwardly to thereby allow the wheelchair to traverse the curb. Some power wheelchairs also have elevatable seats that permit the occupant to move at "eye-level" with persons walking with them. However, wheelchairs operating with seats at elevated positions are susceptible to instability under certain conditions, and anti-tip assemblies, while beneficial for climbing obstacles such as curbs, may contribute to the instability when the wheelchair is operating on other than flat, level ground.

BRIEF SUMMARY OF THE INVENTION

In one embodiment there is a powered wheelchair comprising a frame; an arm assembly including an arm that is pivotably coupled to the frame, the arm assembly including a wheel coupled to the arm; a suspension coupled to the frame and to the arm assembly; a drive system coupled to the arm assembly and configured to drive a drive wheel; and an arm limiter pivotably coupled to the suspension and coupled to one or more of the arm assembly and the drive system in an engaged position, the arm limiter being configured to limit movement of the arm assembly in the engaged position. In one embodiment, the arm limiter includes a latch arm, the latch arm having a notch for engaging a catch extending from the one or more of the arm assembly and the drive system in the engaged position. In one embodiment, the latch arm is bent generally in the shape of a question mark. In one embodiment, the arm limiter includes a spring coupled between the latch arm and the suspension, the spring being configured to bias the latch arm toward the engaged position. In one embodiment, the latch arm includes a free distal end configured to engage with a projection extending from a lift mechanism of the powered wheelchair.

In a further embodiment, the powered wheelchair includes an expandable traction member coupled to one or more of the arm assembly and the drive system and to the frame. In one embodiment, the expandable traction member is configured to bias the arm assembly upwardly relative to a ground surface. In one embodiment, the arm limiter is pivotably coupled to the suspension proximate where the expandable traction member is coupled to the frame.

In a further embodiment, the powered wheelchair includes a lift mechanism supported by the frame; and a seat supported by the lift mechanism, the lift mechanism configured to move the seat between a lowered position and a raised position. In one embodiment, the lift mechanism includes a projection configured to engage the arm limiter in the lowered position and release the arm limiter in the raised position and allow the arm limiter to transition to the engaged position. In one embodiment, the suspension includes a lever pivotably coupled to the frame and a compression spring coupled between the frame and the lever, the arm limiter being pivotably coupled to the lever. In one embodiment, the arm limiter is prevented from transitioning to the engaged position depending on the position of the arm assembly. In one embodiment, the drive system includes an electric motor and a gear box. In one embodiment, the drive system is rigidly coupled to the arm assembly and indirectly coupled to the frame by the arm assembly. In one embodiment, the arm assembly includes a catch, and the arm limiter is coupled to the catch in the engaged position. In one embodiment, the arm limiter includes a sensor, the drive system being configured to drive the drive wheel at a reduced speed when the sensor detects that the arm limiter is in the engaged position.

In one embodiment, there is a a powered wheelchair comprising: a frame; a lift mechanism supported by the frame; a seat supported by the lift mechanism, the lift mechanism configured to move the seat between a lowered position and a raised position; a pair of drive wheels; at least one drive coupled to the frame and configured to apply a torque to at least one of the drive wheels; an arm assembly including an arm that is pivotably coupled to the frame and a wheel coupled to the arm, the arm configured to be in a first position relative to the frame when the powered wheelchair is operating on flat ground and to be rotatable from that first position, the arm assembly having a suspension coupled to the frame; an arm limiter configured to inhibit motion of the arm when the seat is in the raised position, the arm limiter having a first configuration in which the arm is rotatable from the first position through a first range of rotation, and a second configuration in which the arm is rotatable from the first position only through a second range of rotation that is smaller than the first range of rotation, the arm limiter coupled to the suspension and configured to engage the arm assembly in the second configuration; and a trigger mounted to the lift mechanism and coupled with the arm limiter such that as the seat is moved between the lowered and raised positions, the trigger causes the arm limiter to transition between the first and second configurations, wherein the arm limiter is prevented from transitioning into the second configuration when the arm is rotationally different from the first position relative to the frame by more than a predetermined amount.

In one embodiment, the trigger is configured to urge the arm limiter toward the first configuration as the lift mechanism moves the seat from the raised position to the lowered position. In one embodiment, the predetermined amount is greater than or equal to 4 degrees. In one embodiment, the trigger includes a projection projecting laterally from a side of the lift mechanism. In one embodiment, the suspension comprises a first suspension component having a first range of travel and a second suspension component having a second range of travel that is less than the first range of travel and wherein the second suspension component is configured to move through the second range of travel during operation of the powered wheelchair only when the arm limiter is in the second position. In one embodiment, the first suspension component is configured to compress an amount that is less than the first range of travel when the arm limiter is in the second position. In one embodiment, the second suspension component is configured to compress through the entire second range of travel when the arm limiter is in the second position.

In one embodiment, there is a powered wheelchair comprising: a frame; a lift mechanism supported by the frame; a seat supported by the lift mechanism, the lift mechanism configured to move the seat between a lowered position and a raised position; a pair of drive wheels; at least one drive coupled to the frame and configured to apply a torque to at least one of the drive wheels; an arm limiter; an arm assembly including an arm that is pivotably coupled to the frame and a wheel coupled to the arm, the arm configured to be in a first position relative to the frame when the powered wheelchair is operating on flat ground and to be rotatable from that first position, the arm assembly having a suspension configured to control motion of the arm assembly relative to the frame depending upon a configuration of an arm limiter, the arm limiter configured to inhibit motion of the arm when the lift mechanism is in the raised position, the arm limiter having a first configuration in which the arm assembly is rotatable from the first position through a first range of rotation, and a second configuration in which the arm is rotatable from the first position only through a second range of rotation that is smaller than the first range of rotation, the arm limiter coupled to the suspension and configured to engage the arm assembly in the second configuration; and a trigger mounted to the lift mechanism and coupled with the arm limiter such that as the seat is moved between the lowered and raised positions, the trigger causes the arm limiter to transition between the first and second configurations, wherein the arm limiter is prevented from transitioning into the second configuration when the arm is rotationally different from the first position relative to the frame by more than a predetermined amount.

In one embodiment, the suspension comprises a first suspension component having a first range of travel and a second suspension component having a second range of travel wherein the first suspension component is compressible through the first range of travel when the arm limiter is not in the engaged position and the second suspension component is compressible through the second range of travel when the arm limiter is in the engaged position. In one embodiment, the suspension is a suspension means for controlling motion of the arm assembly relative to the frame depending upon a configuration of an arm limiter.

BRIEF DESCRIPTION OF THE SEVERAL VIEWS OF THE DRAWINGS

The following detailed description of embodiments of an adjustable height wheelchair will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1A:
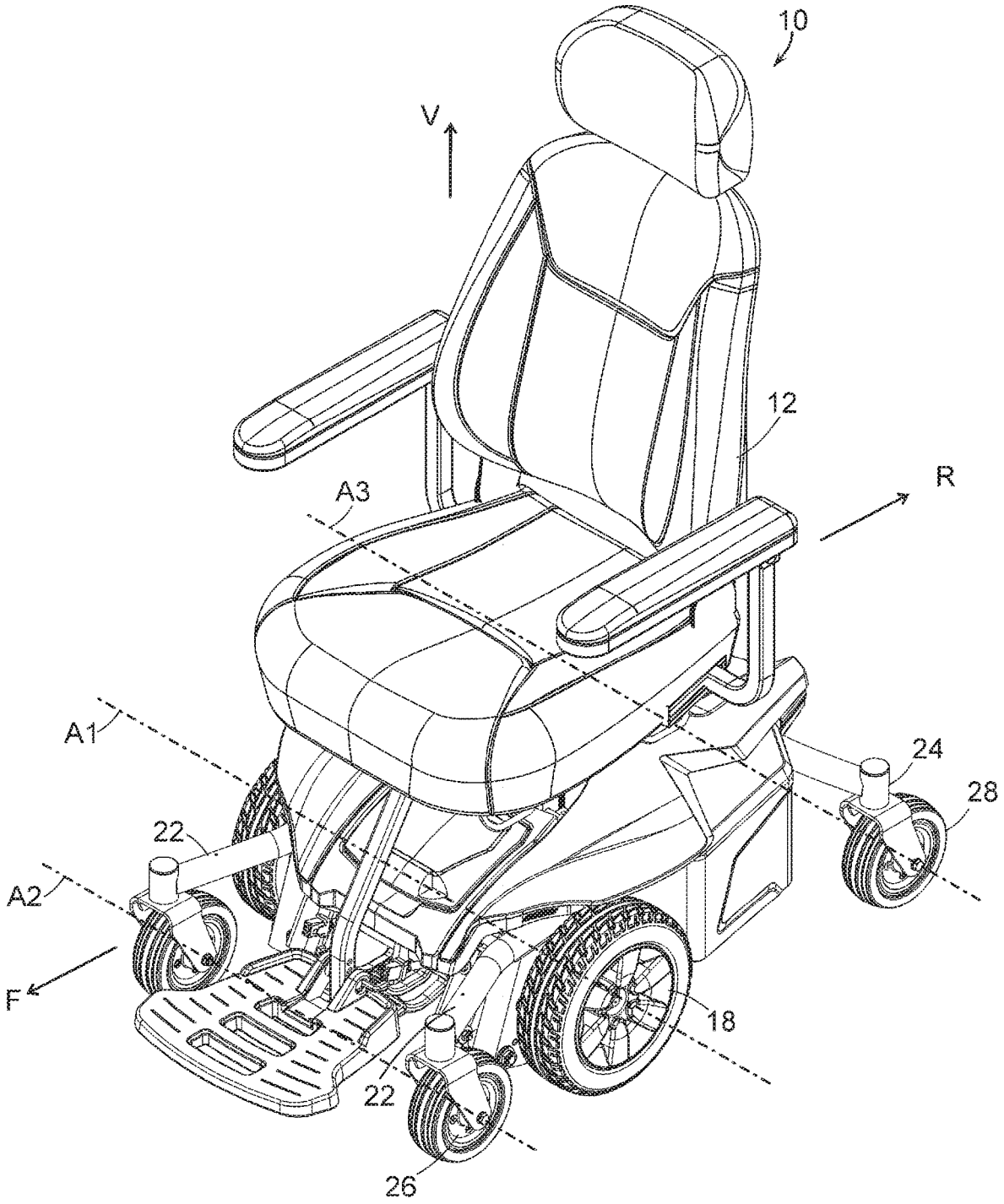
FIG. 1A is a perspective view of an adjustable height wheelchair in accordance with an exemplary embodiment of the present invention shown in the lowered position.

Referring to the drawings in detail, wherein like reference numerals indicate like elements throughout, there is shown in FIGS. 1A-7 an adjustable height wheelchair, generally designated 10, an exemplary embodiment of the present invention. Various embodiments of the adjustable height wheelchair are described in further detail below in reference to the exemplary embodiment shown in the figures. Additional examples of powered wheelchairs having lift and suspension mechanisms are disclosed in U.S. Patent Application Publication No. 2015/0196441 and U.S. Pat. No. 8,408,343 which are hereby incorporated by reference in their entirety.

Figure 3A:
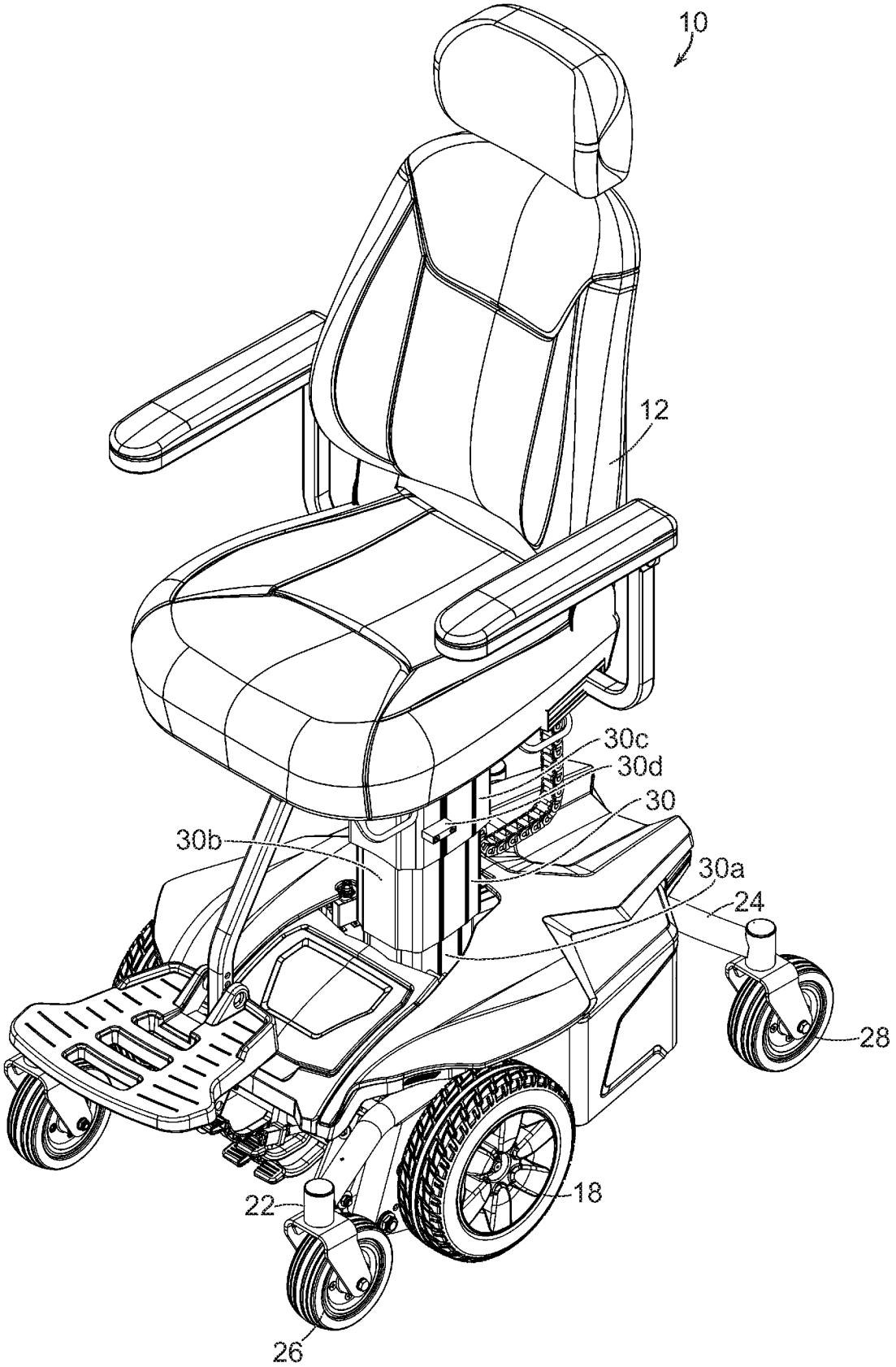
FIG. 3A is a perspective view of the adjustable height wheelchair of FIG. 1A shown in the fully elevated position.
Figure 3C:
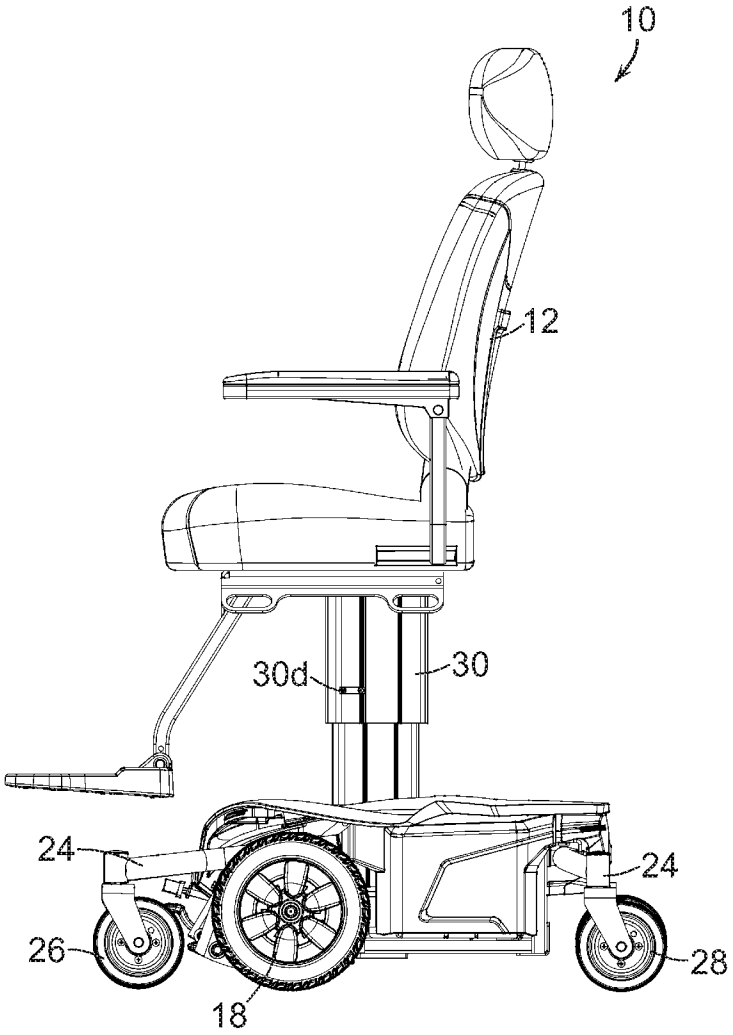
FIG. 3C is a left side view of the adjustable height wheelchair shown in FIG. 3A.

Referring to FIGS. 1A-3C, the adjustable height wheelchair 10 (also referred to as wheelchair 10) may be configured to elevate a seated occupant and operate the wheelchair 10 in a safe, stable condition dependent on the occupant's position, ground surface features, and/or one more or more wheelchair operational parameters. The wheelchair 10 may be configured to elevate a chair or seat 12 between a conventional lowered position (e.g., FIGS. 1A-1C) and raised or elevated positions (e.g., FIGS. 2A-2C illustrate a partially elevated position and FIGS. 3A-3C illustrate a fully elevated position). Providing an adjustable height wheelchair 10 may allow an occupant to operate the wheelchair 10 with the seat 12 in the raised position, which in some circumstances can be at a conversational or eye-to-eye level height with others who are standing or walking along with the wheelchair 10. In one embodiment, the wheelchair 10 raises the seat 12 more than six (6) inches above its most lowered state. In one embodiment, the wheelchair 10 raises the seat 12 seven (7) inches above its most lowered state. In one embodiment, the wheelchair 10 raises the seat 12 eight (8) inches above its most lowered state. In one embodiment, the wheelchair 10 raises the seat 12 nine (9) inches above its most lowered state. In one embodiment, the wheelchair 10 raises the seat 12 ten (10) inches above its most lowered state. In one embodiment, the wheelchair 10 raises the seat 12 more than 10 inches.

The wheelchair 10 may be a powered wheelchair. In some embodiments, wheelchair 10 may be configured to selectively limit certain operational aspects when, for example, the wheelchair 10 is in the process of traversing an obstacle, is on un-level ground, and/or when the seat 12 is raised. Likewise, the wheelchair 10 may prevent the raising of the seat 12 when the wheelchair 10 is climbing an obstacle or is on unlevel ground. An "obstacle" 14 as the term is used herein may include any relatively raised or lowered structure on the ground surface G that the wheel must ascend or descend to cross over (see FIGS. 5A-6B). Operating a wheelchair when the seat is in the elevated position can create instability, especially when climbing curbs or transitioning to a descent when appropriate safety features are not deployed. For instance, when the seat 12 is in the fully raised position, the center of gravity of the occupied wheelchair is also elevated and/or shifted forward or rearward (depending, for example, on the lift mechanism associated with the chair). The risk of tipping can increase on an incline and overall wheelchair stability can be compromised, especially when traversing or attempting to traverse an obstacle.

The wheelchair 10 may be configured with supplemental stability features when the seat 12 is in the elevated position. The supplemental stability configuration may permit wheelchair 10 to operate at increase travelling speeds when the chair is elevated as compared to elevated height wheelchairs that are not so configured. Increased traveling speeds may include walking, jogging, or running speeds. Conversational height as used herein refers to when the occupant is elevated to a level above the ground surface G (see FIGS. 5A-6B) to make communication with others (e.g., average height adult males or females) standing or walking next to the wheelchair 10 easier. For example, conversational height could place the user "eye-level" with someone standing next to the wheelchair 10.

Figure 1C:
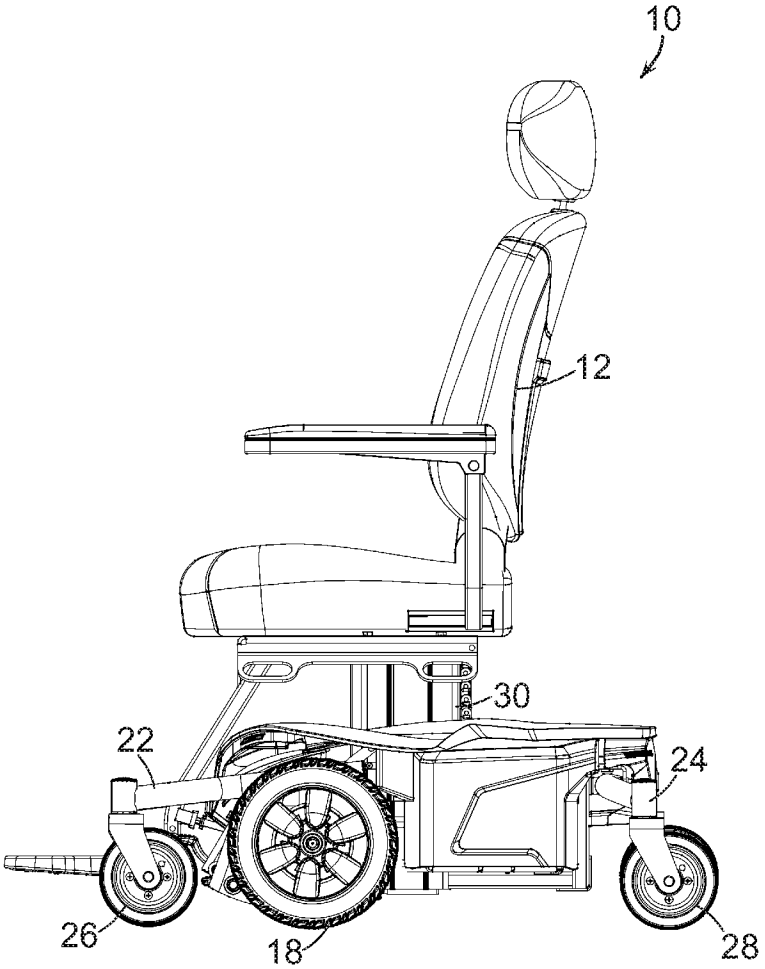
FIG. 1C is a left side view of the adjustable height wheelchair shown in FIG. 1A.
Figure 1B:
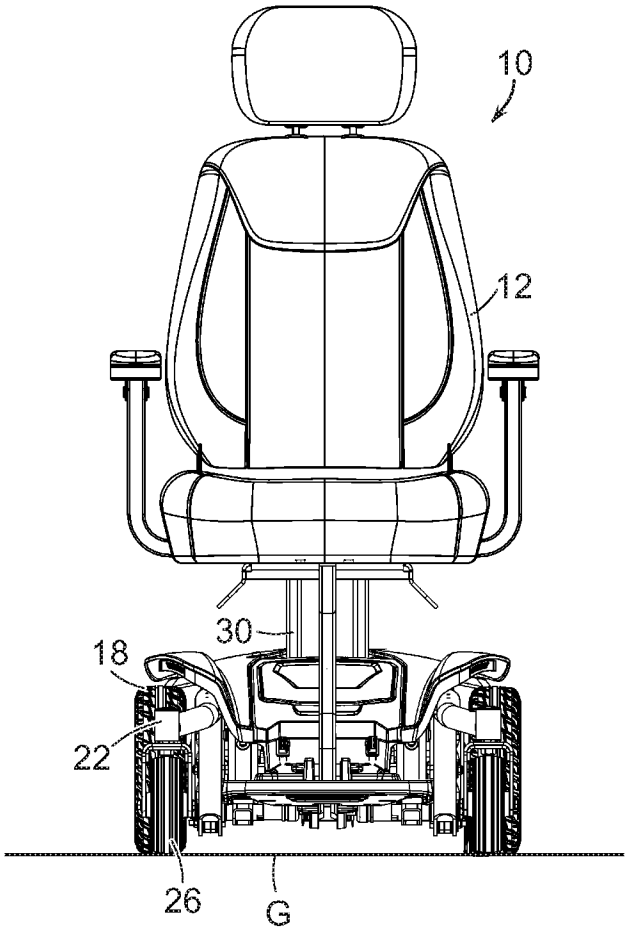
FIG. 1B is a front view of the adjustable height wheelchair shown in FIG. 1A.
Figure 2A:
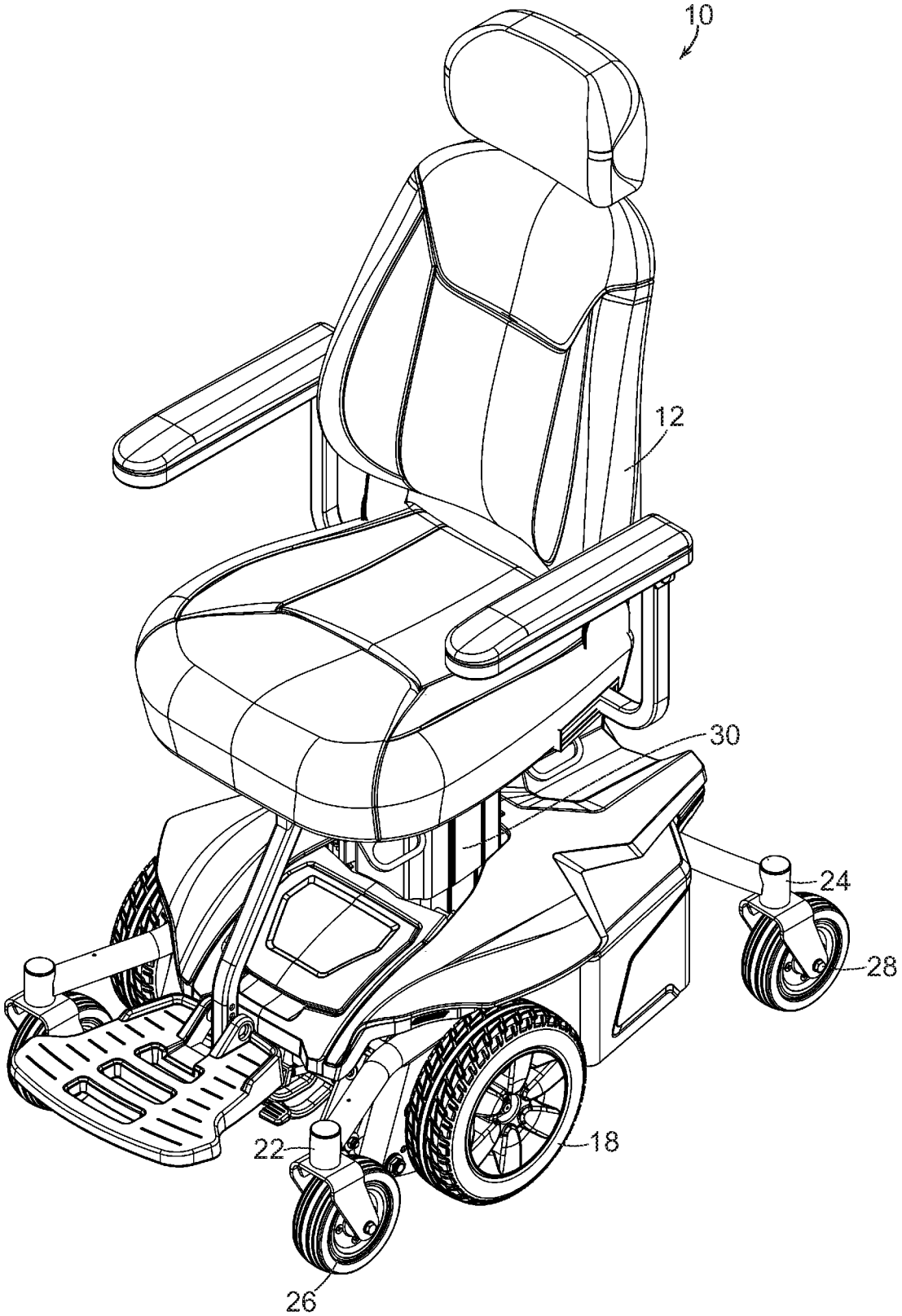
FIG. 2A is a perspective view of the adjustable height wheelchair of FIG. 1A shown in a partially elevated position.
Figure 2C:
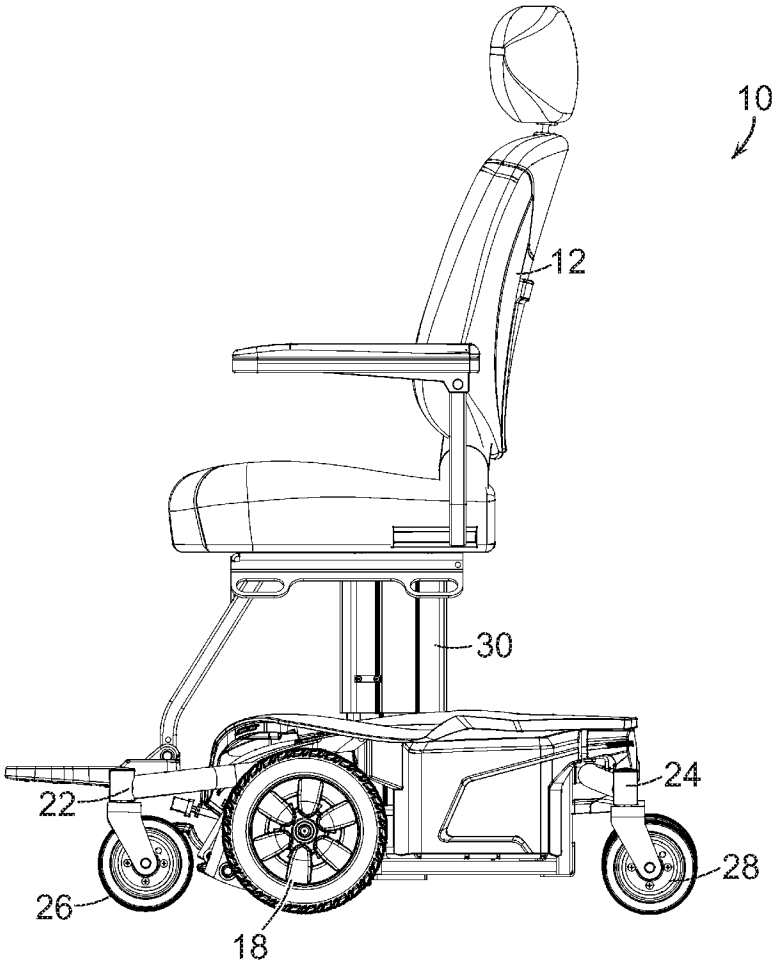
FIG. 2C is a left side view of the adjustable height wheelchair shown in FIG. 2A.
Figure 2B:
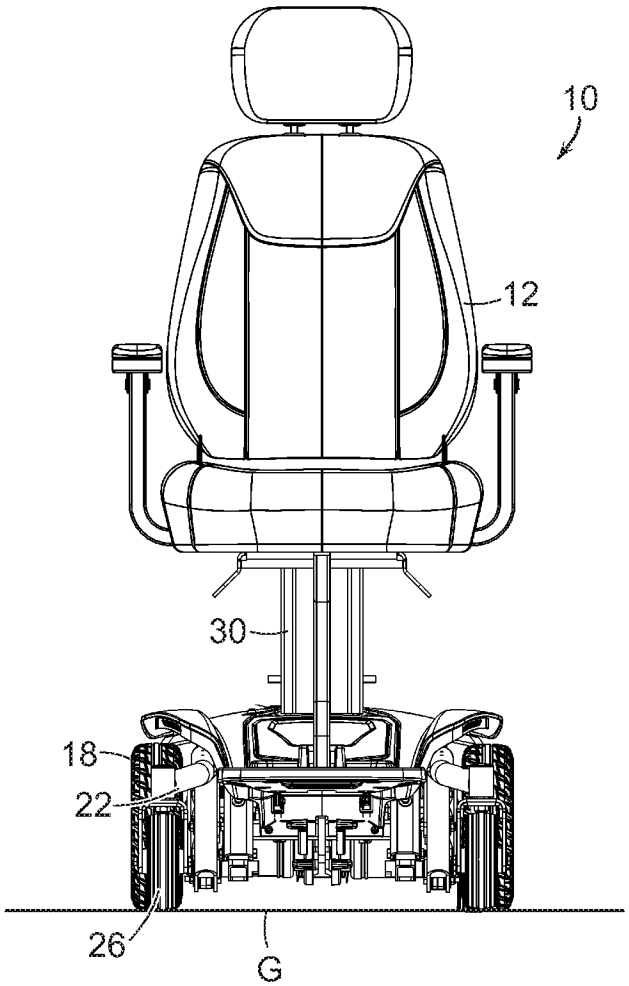
FIG. 2B is a front view of the adjustable height wheelchair shown in FIG. 2A.
Figure 4A:
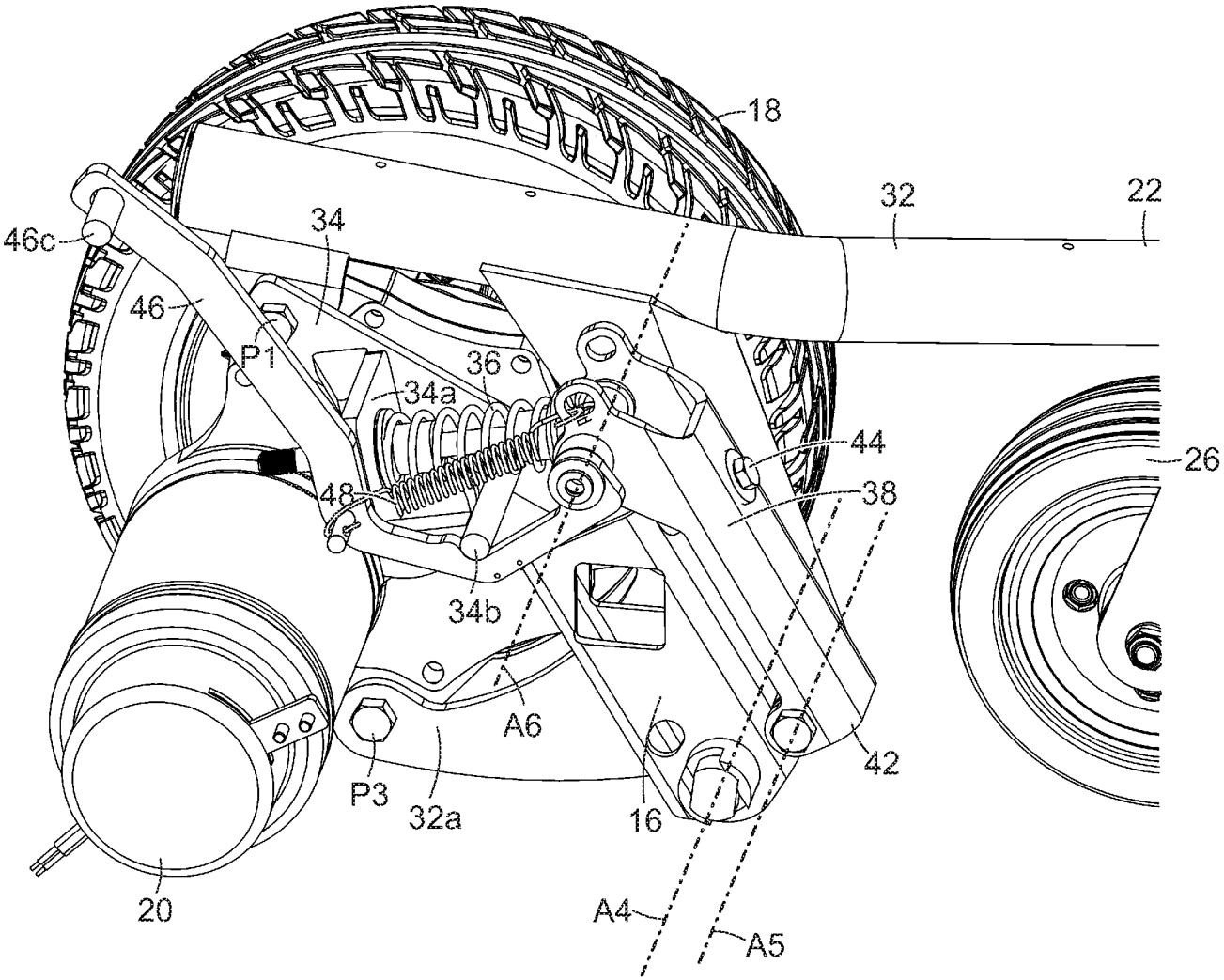
FIG. 4A is a top perspective view of a suspension system of the adjustable height wheelchair shown in FIG. 1A.

With continued reference to FIGS. 1A-1C, the powered wheelchair 10 may include a frame 16 (see FIG. 7), a pair of drive wheels 18 coupled to the frame 16 and driven by at least one drive system 20 (see FIG. 4A). A pair of front anti-tip arm assemblies 22 may extend from the frame 16 in a forward direction F relative to the drive wheels 18. A pair of rear anti-tip arm assemblies 24 may extend from the frame 16 in a rearward direction R that is opposite to the forward direction F. As used herein the forward-rearward direction F-R may refer the horizontal direction when the wheelchair is operating on flat, level ground. In accordance with the illustrated embodiment, the wheelchair 10 may be a mid-wheel drive power wheelchair and include front wheels 26 and rear wheels 28 disposed in the forward and rearward directions F and R relative to the drive wheels 18, respectively. The drive system 20 may include an electric motor and gear box configured to cause the drive wheels 18 to rotate about the drive wheel axis $A_1$ to advance the wheelchair 10 along the surface G. The front wheel 26 may be rotatable about the front wheel axis $A_2$ and the rear wheel 28 may be rotatable about the rear wheel axis $A_3$. The present disclosure, however, is not limited to mid-wheel powered wheel chairs and may include any number of wheels.

Figure 3B:
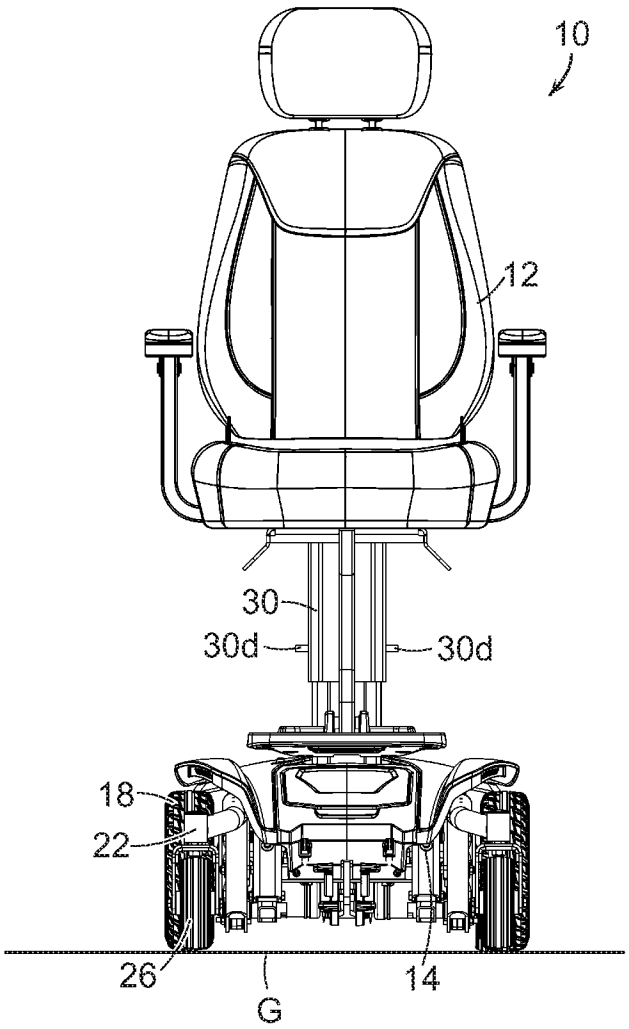
FIG. 3B is a front view of the adjustable height wheelchair shown in FIG. 3A.

Referring to FIGS. 3A-3C, the powered wheelchair 10 may also include a lift mechanism 30 mounted to the frame 16 with the seat 12 supported by the lift mechanism 30. The lift mechanism 30 may be configured to, in response to inputs an occupant applies to an input device for example, move the seat 12 between a lowered position (FIGS. 1A-1C) and a raised position (FIGS. 3A-3C) generally along a vertical direction V (see FIG. 1A) that is substantially perpendicular the forward and rearward directions F and R. The lift mechanism 30 may include a telescopic pillar mechanism as shown. The lift mechanism 30 may include a screw type actuator. In one embodiment, the lift mechanism 30 includes two or more housing segments (e.g., 30*a*, 30*b*, 30*c*) that are telescopically coupled to one another to cover the actuator. In one embodiment, the housing segments 30*a*, 30*b*, 30*c* are arranged such that the top segment 30*c* slides over the middle segment 30*b* which slides over the bottom segment 30*a*. The housing segments (e.g., 30*a*, 30*b*, 30*c*) may have a non-circular cross sectional shape to prevent the chair 12 from rotating relative to the frame 16. In one embodiment, the housing segments (e.g., 30*a*, 30*b*, 30*c*) are generally rectangular in cross sectional shape. In other embodiments, the housing segments (e.g., 30*a*, 30*b*, 30*c*) are generally triangular or oval in cross sectional shape. In other embodiments, the housing segments (e.g., 30*a*, 30*b*, 30*c*) are generally circular in cross sectional shape to allow the chair 12 to rotate relative to the frame 16.

In other embodiments, another type of lift mechanism may be employed such as a scissor lift. Further, the wheelchair 10 can be configured to move the seat 12 into the raised position and tilt the seat base and seat back relative to each other in the raised position. In an embodiment, the wheelchair 10 can include a lift and tilt mechanism, such as the lift and tilt mechanism disclosed in U.S. Patent App. Pub. No. 2014/0262566, entitled "Lift Mechanism And Tilt Mechanism For A Power Wheelchair," incorporated by reference herein in its entirety.

The lift mechanism 30 may include a trigger 30*d*. The trigger 30*d* may include a block extending laterally from the lift mechanism 30. In one embodiment, the trigger 30*d* extends from the outermost top segment 30*c*. In one embodiment, a trigger 30*d* extends from each lateral side of the lift mechanism 30 in direction generally perpendicular to the forward F and rearward R directions (see FIG. 1A). The trigger 30*d* may be configured to engage and release an arm limiter as discussed in further detail below.

Figure 4B:
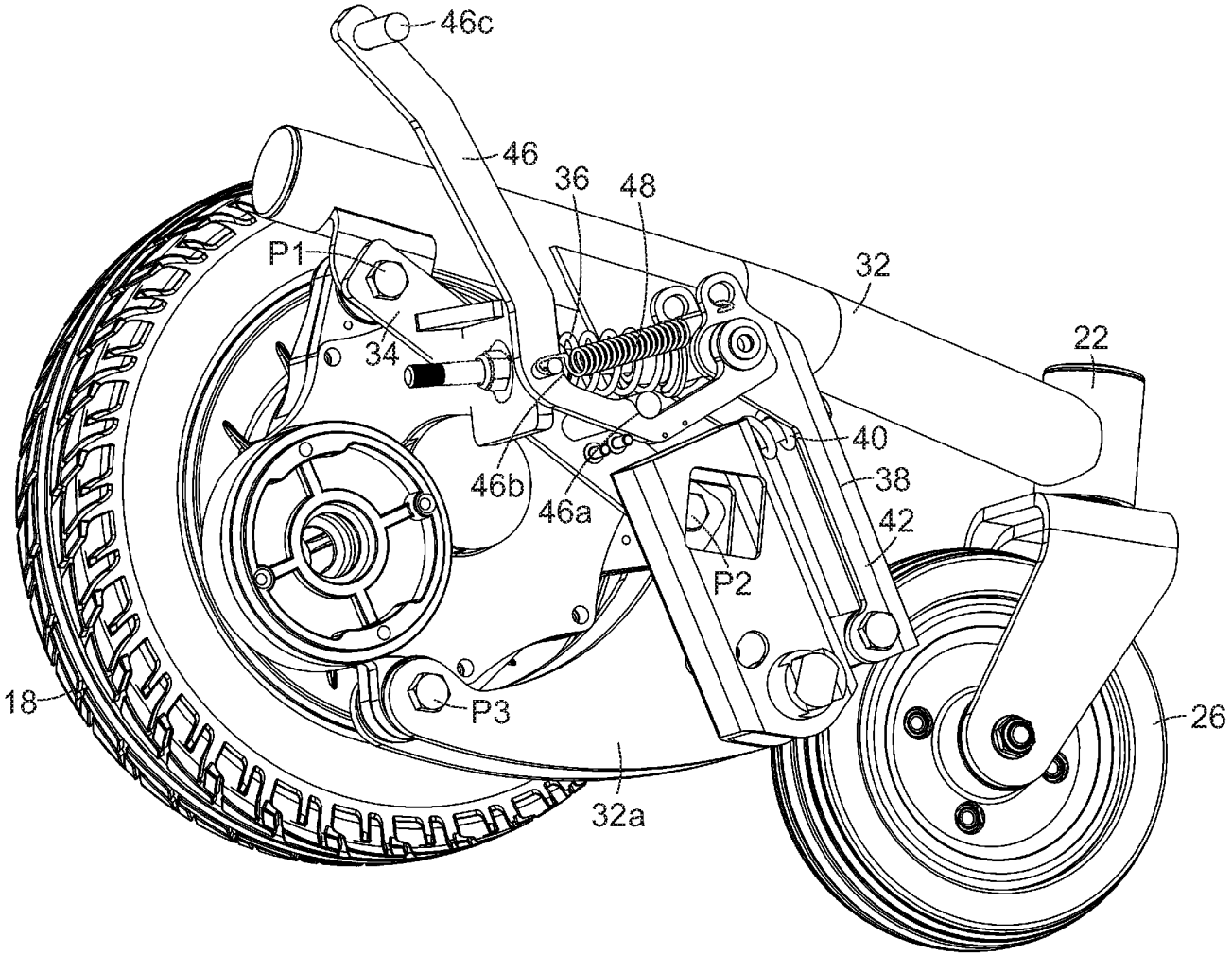
FIG. 4B is a bottom perspective view of the suspension system of FIG. 4A.

Turning to FIGS. 4A and 4B, as noted above, the wheelchair 10 includes a pair of front anti-tip arm assemblies 22. For ease of illustration only one anti-tip arm assembly 22 is shown and described below. The other anti-tip assembly 22 in the pair preferably has the same structure but oriented on the opposite side of the wheelchair 10. The anti-tip arm assembly 22 may also be referred to in this disclosure as an arm assembly 22. In one embodiment, the arm assembly 22 is rotatable coupled to frame 16. For example, the arm assembly 22 may include an arm member 32 rotatably coupled to the frame 16. A front wheel 26 may also be coupled to the arm assembly (e.g., the wheel 26 may be coupled to the arm member 32). The arm member 32 may include an arm extension 32*a*. The arm extension 32*a* may extend downwardly from the arm member 32. In one embodiment, the arm extension 32*a* is hook shaped (see FIG. 7). In one embodiment, the arm extension 32*a* is rigidly connected to the arm member 32. The arm extension 32*a* may be pivotably coupled to the frame 16. In one embodiment, arm assembly 22 may be directly coupled to frame 16 only via arm extension 32*a*. In one embodiment, the arm extension 32*a* is pivotably coupled to the frame 16 about axis $A_4$. In one embodiment, axis $A_4$ is generally parallel with axis $A_1$ (see FIG. 1A). The arm member 32 and arm extension 32*a* can be formed of multiple components that are connected together with fasteners or welds, or pivotally attached together, without limitation. In other embodiments, the arm member 32 and arm extension 32*a* can be a monolithic structure, such as a cast or extruded material.

Referring to FIGS. 5A-6B, the front wheel 26 is coupled to the distal end of the arm assembly 22 and is rotatable about the front wheel axis $A_2$. As illustrated, the front wheel 26 is in contact with ground or surface G during normal operation. The front wheel 26 may be part of a caster assembly. The caster assembly rotatably couples the front wheel 26 to the arm member 22 such that front wheel 26 is rotatable about an axis that is generally perpendicular to the ground surface G and perpendicular the wheel axis $A_2$. In some embodiments, the front wheel 26 can be an anti-tip wheel that is raised or otherwise spaced from the ground or surface G during normal operation in a configuration that does not include a caster. The term "anti-tip" wheel as used herein encompasses caster wheel assemblies (that may include for example, front wheel 26) and anti-tip wheels that are raisable during normal operation and encompasses wheels in the front and the rear of the wheelchair 10. In some embodiments, the raisable anti-tip wheels can have a first or rest position when the wheelchair 10 is operating on flat, level ground G.

The arm assembly 22 may be coupled to the frame 16 and configured to move the wheel 26 relative to the frame 16 upon encountering an obstacle 14. The arm assembly 22 may be pivotably coupled the frame 16 such that the arm assembly 22 and wheel axis $A_2$ pivot about the pivot axis $A_4$. It should be appreciated, however, that the arm assemblies 22 can be coupled to the frame 16 such that the arm member 22 and wheel axis $A_2$ translate relative to the frame 16.

Referring to FIGS. 4A and 4B, the arm assembly 22 may be coupled to the drive system 20. The drive system 20 may be rigidly coupled to the arm assembly 22 and indirectly coupled to the frame 16 by, for example, the arm assembly 22. In one embodiment, the drive system 20 and the arm assembly 22 are configured to pivot relative to the frame 16 together about a common axis $A_4$. Coupling the drive system 20 and the arm assembly to one another may allow for a simplified suspension system such as those described in further detail below. In one embodiment, the arm assembly 22 is coupled to the drive system 20 at a plurality of points (e.g., $P_1$, $P_2$, $P_3$) around the drive axis $A_1$. In one embodiment, the arm assembly 22 is coupled to the drive system 20 at the plurality of points (e.g., $P_1$, $P_2$, $P_3$) via a fastener such as a bolt. In one embodiment, a tie bar 34 extends between two (or at least two) of the points (e.g., $P_1$ and $P_2$). Because the tie bar 34 may be rigidly coupled to both the arm assembly 22 and the drive system 20, the tie bar 34 in some embodiments may be considered to be part of the arm assembly 22 or part of the drive system 20. In other embodiments, the drive system 20 may be moveably connected to the arm assembly 22, at least initially, to allow the drive system 20 to rotate relative to the frame 16 a predetermined amount before moving simultaneously with the arm assembly 22.

Figure 7:
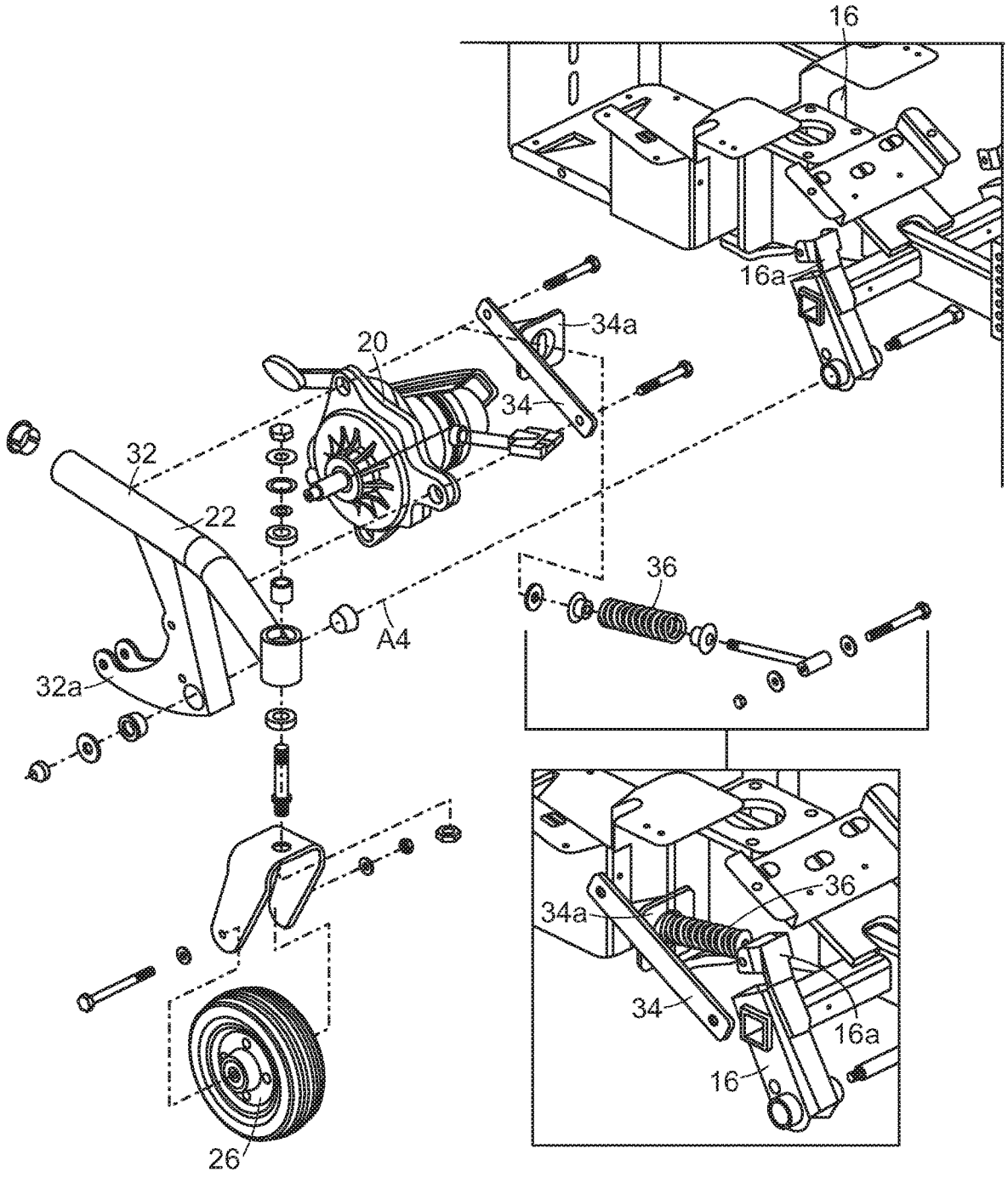
FIG. 7 is an exploded perspective view of the anti-tip arm assembly of the adjustable height wheelchair shown in FIG. 1A with the arm limiter and the suspension omitted.

Referring to FIG. 7, a traction member 36 may be coupled between one or more of the arm assembly 22 and the drive system 20 and to the frame 16. For example, traction member 36 may be coupled between the arm assembly 22 and the frame 16, or traction member 36 may be coupled between the drive system 20 and to the frame 16. The traction member 36 may include a biasing member such as a tension spring or in some embodiments, a compression spring. In one embodiment, the traction member 36 is provided to urge the drive wheel 18 downward so that the drive wheel 18 maintains contact with the ground surface G. In one embodiment, the traction member 36 is coupled to a bracket 34*a* extending from the tie bar 34 at one end and to an extension arm 16*a* of the frame 16 at another end.

Referring to FIGS. 4A-4B, the wheelchair may include one or more arm limiters 46 configured to selectively engage one or more of the arm assemblies 22 so as to inhibit relative motion between the one or more arm assembly assemblies 22 and frame 16. In one embodiment, an arm limiter 46 is configured to automatically engage one or more of the arm assemblies upon the occurrence of a predefined operational condition of in certain instances during operation of the wheelchair 10 (e.g., when the wheelchair is in an elevated condition). The arm limiter 46 may be coupled to the frame 16. In some embodiments, the arm limiter 46 is indirectly coupled to the frame 16 by a suspension as discussed below. When the wheelchair 10 is in an elevated position and the center of gravity is raised, the arm assembly 22 without arm limiter 46 may not provide sufficient support and result in instability or tipping of the chair. Preventing relative motion between the arm assembly 22 and the frame 16 can limit certain operation conditions of the wheelchair 10 in order to improve stability and occupant safety. The arm limiter 46 may transition between a first or disengaged configuration and a second or engaged configuration where operational movement of the arm assembly 22 is limited. Further, operation of arm limiter 46 may be limited, inhibited, impaired or delayed when the wheelchair is traversing an obstacle 14. For instance, the arm limiter 46 may not transition into an engaged configuration if the arm assembly 22 is engaged in attempting to traverse an obstacle 14, as will be further discussed below.

Referring to FIGS. 4A and 4B, the wheelchair 10 may include an obstacle suspension 38. The obstacle suspension 38 may include a biasing member such as a compression spring 40. The suspension 38 may be coupled to the arm limiter 46 (e.g., at one end of the obstacle suspension 38) and the frame 16 (e.g., at another end of the obstacle suspension 38) to couple the arm limiter 46 to the frame 16. In one embodiment, the suspension 38 is considered part of the arm limiter 46. The suspension 38 may be pivotably coupled to frame 16—about axis $A_5$, for example. In one embodiment, obstacle suspension 38 may include a lever 42 pivotably coupled to the frame 16 about axis $A_5$. In one embodiment, axis $A_5$ is generally parallel with axis $A_4$. In one embodiment, axis $A_5$ is proximate axis $A_4$. In one embodiment, axis $A_5$ is positioned between axis $A_4$ and the wheel 26. The lever 42 may be coupled to the frame 16 by a fastener such as a bolt. A fastener 44, such as a bolt, may be coupled to the frame 16, extend through the compression spring 40 and be coupled to the lever 42. In one embodiment, the suspension 38 is configured to resist the pivoting of arm assembly 32 relative to the frame. For example, the suspension 38 may be configured to resist an upward movement (in the vertical direction V, see FIG. 1A) of wheel 26 and/or an upward impact on wheel 26.

In one embodiment, the arm limiter 46 is configured to limit movement of the arm assembly 22 relative to the frame in an engaged position. The engaged position may include a configuration in which the arm limiter 46 may be coupled to the suspension 38 and coupled to one or more of the arm assembly 22 and the drive system 20. In one embodiment, the arm limiter 46 is configured to engage the tie bar 34 in the engaged position. In one embodiment, the arm limiter 46 is configured to engage a catch 34*b* extending from the tie bar 34 in the engaged position. The arm limiter 46 may be pivotably coupled to the obstacle suspension 38. In one embodiment, the arm limiter 46 is pivotably coupled to the obstacle suspension 38 about axis $A_6$. In one embodiment, axis $A_6$ is generally parallel to axis $A_4$. In one embodiment, arm limiter 46 is coupled to the obstacle suspension 38 proximate where the traction member 36 is coupled to the frame 16.

The arm limiter 46 may be in the form of a latch arm 46. The arm limiter 46 may have a first notch 46*a* configured to engage the catch 34*b* extending from the tie bar 34 in the engaged position. The arm limiter 46 may include a second notch 46*b* configured to engage the catch 34*b* extending from the tie bar 34 in the disengaged position. The arm limiter 46 may be bent generally in the shape of a question mark. In one embodiment, arm limited 46 is biased to pivot toward obstacle suspension 38—for example, into a position that reduce a range of travel of obstacle suspension 38 as described herein. In one embodiment, a biasing member such as a tension spring 48 is coupled between the arm limiter 46 and the suspension 38. The spring 48 being configured to bias the arm limiter 46 toward the engaged position. The arm limiter 46 may be shaped such that the first and second notches 46*a*, 46*b* are within a pocket between the spring 48 and arm limiter 46. The arm limiter 46 may have a distal end 46*c* that is configured to engage with the trigger 30*d* of the lift mechanism. In one embodiment, the distal end 46*c* of the latch arm 46 is a free end. The distal end 46*c* may be shaped to be generally parallel with axis $A_4$.

Figure 5A:
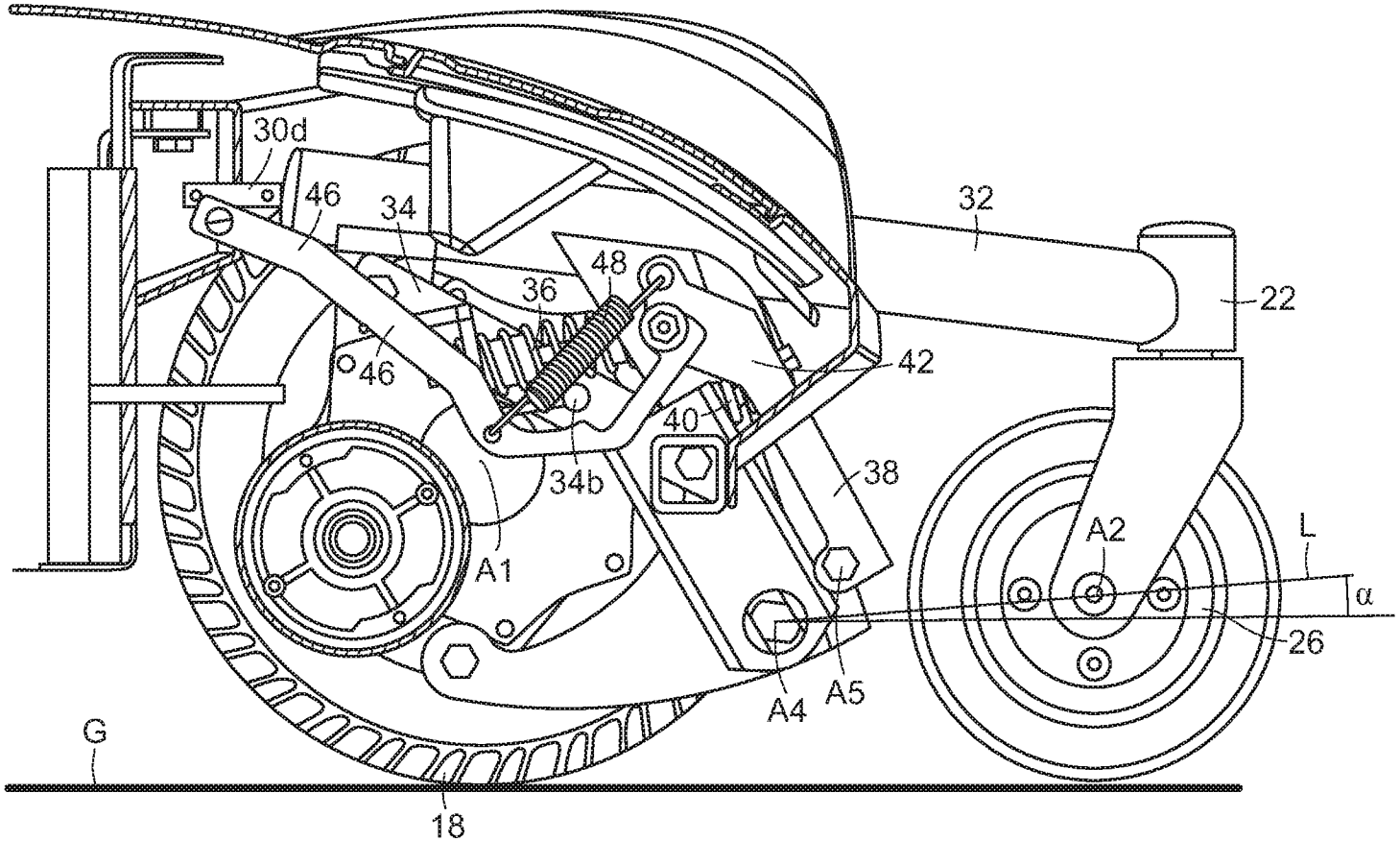
FIG. 5A is a side view of the suspension system of FIG. 4A shown with the chair in the lowered position and the wheels on a generally flat surface.
Figure 5B:
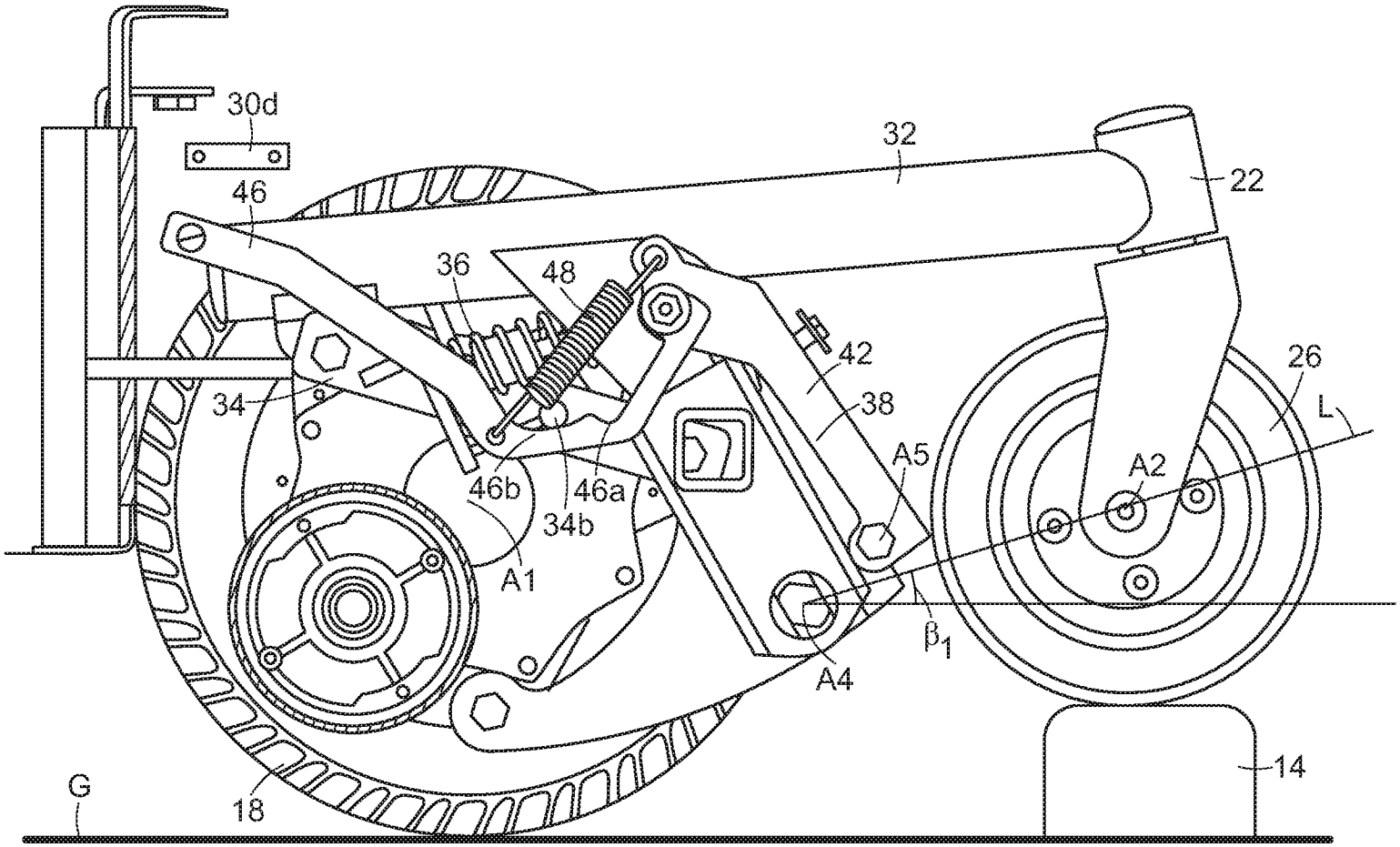
FIG. 5B is a side view of the suspension system of FIG. 4A shown with the chair in the lowered position and the front wheel climbing.

Referring to FIGS. 5A and 5B, the arm limiter 46 is shown in the disengaged position. On level ground G such as shown in FIG. 5A, with the seat in the lowered position, the trigger 30*d* may engage the arm limiter 46 (e.g., at the distal end of the arm limiter 46) and space the arm limiter 46 from the catch 34*b*. When the wheel 26 encounters an obstacle 14 such as shown in FIG. 5B, the arm assembly 22 is pivoted relative to frame 16 an angle $\beta_1$ until the catch 34*b* engages a second notch 46*b* of the arm limiter pivoting the arm limiter 46 relative to the suspension 38. The arm assembly 22 may pivot relative to the frame (e.g., about axis $A_4$) until the spring 40 (see FIG. 4B) of the suspension 38 is fully compressed. In other embodiments, the vertical pivot limit of the arm assembly 22 is dictated by a limit of the traction member 36. As illustrated in FIG. 5B, the arm limiter 46 is prevented from transitioning to the engaged position depending on the position of the arm assembly 22.

Figure 6A:
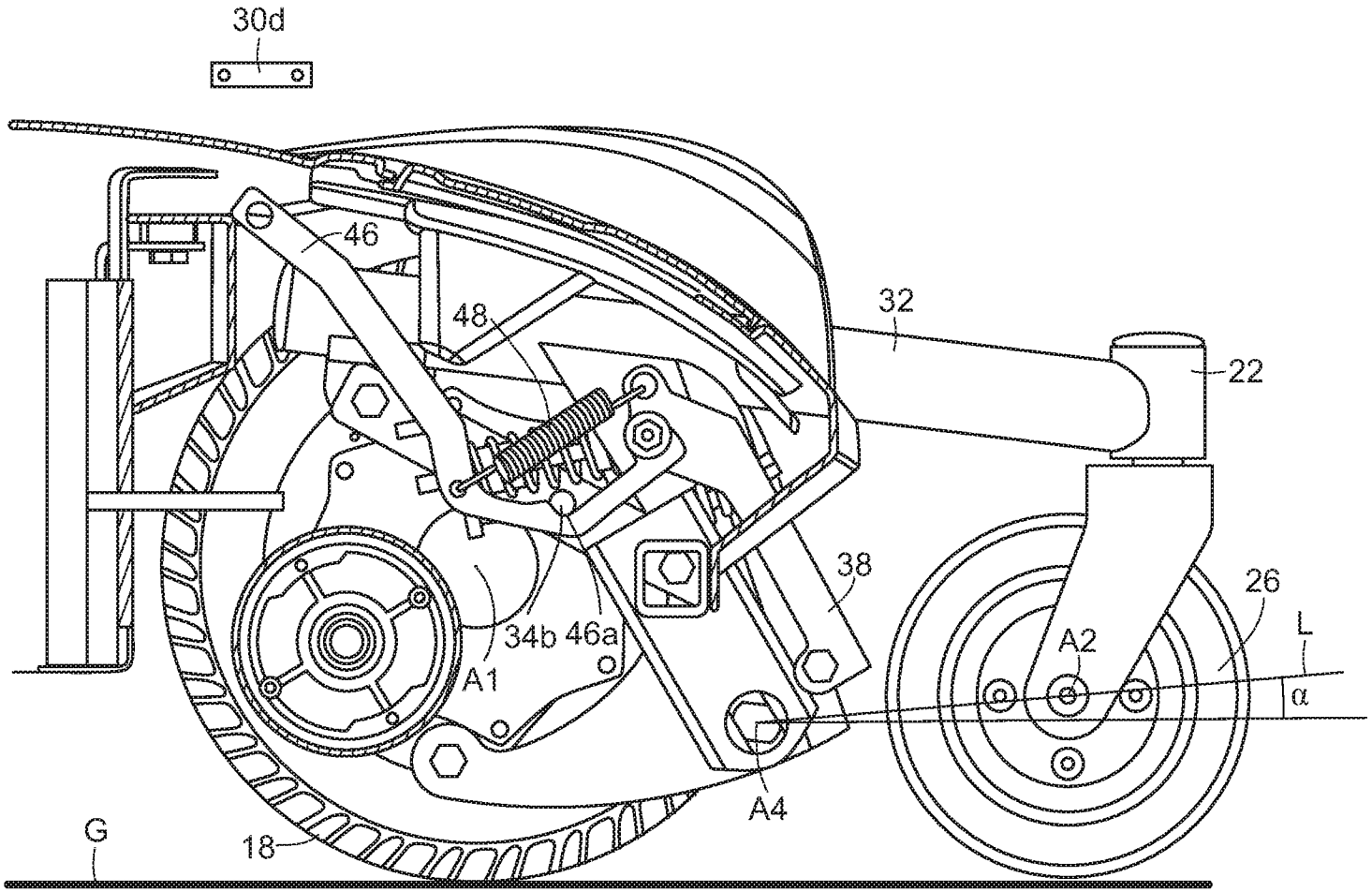
FIG. 6A is a side view of the suspension system of FIG. 4A shown with the chair in the elevated position and the wheels on a generally flat surface.
Figure 6B:
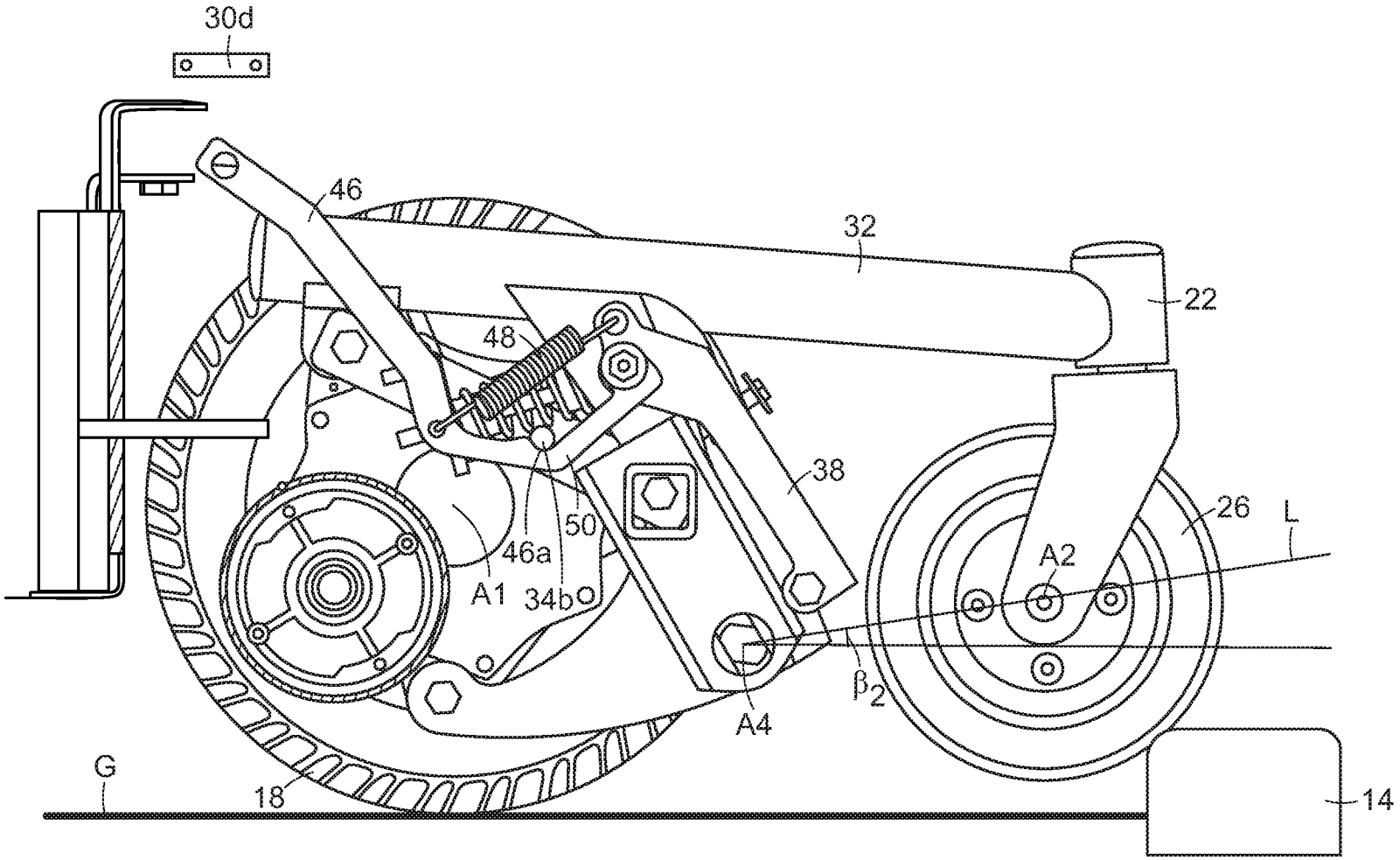
FIG. 6B is a side view of the suspension system of FIG. 4A shown with the chair in the elevated position and the front wheel climbing.

Referring to FIGS. 6A and 6B, the arm limiter 46 is shown in the engaged position. On level ground G such as shown in FIG. 6A, with the seat in the elevated position, the trigger 30*d* may be disengaged from the distal end of the arm limiter 46 such that the biasing member 48 pivots the arm limiter 46 relative to arm assembly 22 until the first notch 46*a* of the arm limiter 46 is engaged with the catch 34*b*. When the wheel 26 encounters an obstacle 14 such as shown in FIG. 5B, the arm assembly 22 is pivoted relative to frame 16 an angle $\beta_2$ until the spring 40 of the suspension 38 is fully compressed. In one embodiment, lowering the seat 12 causes the trigger 30*d* to engage the distal end of the arm limiter 46, releasing the arm limiter 46 from the catch 34*b*. In one embodiment wheelchair 10 includes a sensor 50 for detecting when the arm limiter 46 is in the engaged position. The sensor 50 may be a contact sensor, an electromagnetic sensor and/or a proximity sensor. The sensor 50 may be positioned on or proximate to catch 34*b*. In one embodiment, the arm limiter 46 includes a sensor 50 proximate the first notch 46*a*. Such a sensor 50 may indicate to a controller that the arm limiter 46 is in the engaged position. In one embodiment, a controller receives a signal from sensor 50 that indicates arm limiter 46 is in the engaged position and in response to the signal generates a control signal that implements a selected and select a desired operation of the wheelchair 10 as discussed in further detail below.

Referring to FIGS. 5A-6B, the wheelchair 10 may have different operational modes, such as a standard mode and one or more elevated motion modes. In some embodiments, a control system includes a controller configured to operate the wheelchair 10 in the different operational modes, an input device in electronic communication with the controller, and one or more sensors in electronic communication with the controller. The controller may be responsive to inputs from the input device and one or more of the sensors in order to cause the wheelchair 10 to operate at least in (i) a standard mode when the seat 12 is in the lowered position such that the wheelchair 10 is moveable along the surface G in accordance with standard drive parameters (that is, conventional parameters that are not limited for elevated seat operation), and (ii) one or more elevated motion modes whereby the seat 12 is in the raised position and drive parameters are limited to some extent. The elevated motion modes may include A) a first or normal elevated motion mode where the wheelchair is capable operating according to a first set of limited drive parameters, and B) a second elevated motion mode (sometimes referred to as an elevated-inhibited mode) whereby the wheelchair 10 is capable of operating according to a second set of limited drive parameters that have limits that are typically less than upper limits of the first set of limited drive parameters. The phrase "drive parameters" as used herein (whether in standard or elevated modes) may include a speed (miles/hr), acceleration, and deceleration of the wheelchair 10. In some embodiments, the drive parameters include directional components, such as forward speed, reverse speed, and turn speed, forward acceleration, forward deceleration, reverse acceleration, and reverse deceleration. For brevity and ease of illustration, the standard and elevated modes below are described with reference to the speed of the wheelchair 10. However, it should be appreciated that the ranges and limits discussed below with respect to speed are applicable to the other drive parameters such as turn speed, acceleration, and deceleration described above.

In one embodiment, the standard mode may be when the seat 12 is in the lowered position such that the wheelchair is moveable along the surface G at typical wheelchair speeds. The first elevated motion mode can be when the wheelchair 10 is capable of moving at a first speed range, up to a maximum raised-seat drive speed, which is less than the typical wheelchair speeds. The second elevated motion mode (or an elevated-inhibited mode) is when the wheelchair 10 is capable of moving at a second elevated mode speed range, up to a maximum raised-inhibited drive speed that is less than the upper limit of the first speed range.

In the standard mode the wheelchair 10 may move at a standard or lowered-seat drive speed range that is typical of conventional wheelchairs, such from 0.0 mph to about 10.0 mph. Accordingly, it should be appreciated that the fully lowered-seat drive speed can have an upper limit that is anywhere in the conventional range from a practical minimum (or at rest at 0 mph) to, for example, 10.0 mph as indicated. Furthermore, it should be appreciated that when the wheelchair 10 is operating in the standard mode, the wheelchair 10 can be configured to move at any speed as desired and is not limited to a speed that is between the practical minimum and 10.0 mph. The powered wheelchair 10 would typically be in the standard mode (that is, with the seat in the fully-lowered position) when the wheelchair 10 is traversing obstacle 14 such as a curb. The term "standard mode" includes a mode that has no speed restrictions by the controller that are related to seat position.

When in the elevated motion modes, the wheelchair 10 may be configured to move at a speed that has a limit that is less than the standard mode drive speed upper limit. In the elevated motion modes, the wheelchair 10 preferably is capable of moving at a walking speed (or perhaps faster) while seat 12 is in the raised position such that the occupant is at the conversational height with a person walking next the powered wheelchair. In an exemplary embodiment, when in the normal elevated motion mode, the first speed range is from a practical minimum to 5.0 mph, preferably from the practical minimum to 3.75 mph. That is, the wheelchair 10 can be configured to move at a maximum raised-seat drive speed that is no more than 5.0 mph, preferably no more than 3.75 mph. In one embodiment, the wheelchair 10 is configured to move at a maximum raised-seat drive speed that is no more than 3.5. It should be appreciated that the raised-seat drive speed can have an upper limit that is anywhere from a first speed range of the practical minimum to 5.0 mph. Furthermore, when the wheelchair 10 is operating in the normal elevated motion mode, there may be circumstances in which the upper limit may be set higher than 5.0 mph. The term "practical minimum" speed as used herein means that the lower limit of the range is chosen according to the parameters understood by persons familiar with wheelchair structure and function, and may be close to zero mph under some conditions.

In an instance in which wheelchair 10 is operating in the elevated motion mode, and at least one safety criteria is not met, the controller may cause the wheelchair 10 to operate in some mode other than the first, normal elevated motion mode. For example, the controller may cause the wheelchair 10 to operate in the second elevated motion mode or elevated inhibited mode at least until all of the safety criteria are met. For example, in some embodiments, if the seat 12 is in the raised position and one of the safety criteria is not met, the controller may allow the wheelchair 10 to move within the second, elevated-inhibited speed range, up to the reduced maximum raised-inhibited speed that is less then maximum raised-seat drive speed. The maximum raised-inhibited drive speed can be a speed that is no more than 3.0 mph, preferably no more than 1.5 mph. In one embodiment, the maximum raised-inhibited drive speed can be a speed that is no more than 1.25 mph. It should be appreciated, however, that the raised-inhibited drive speed can have any upper limit as desired so long as it is less than an upper limit of the first, normal speed range.

The maximum speed of the wheelchair may be reduced when one or more of the arm limiters is not engaged in the elevated position. In one embodiment, the maximum standard or lowered-seat drive speed is approximately 10 mph, the maximum elevated motion mode speed with both arm limiters engaged is approximately 3.5 mph, and the maximum elevated motion mode speed with one or more arm limiters not engages is approximately 1.25 mph.

Accordingly, in order for the wheelchair 10 to operate in the elevated motion modes, certain safety criteria should be satisfied as will be discussed further below. One or more senors may detect information indicative of when the wheelchair 10 is in a position to safely operate in the elevated motion modes. Those sensors may include contact sensors, electromagnetic sensor and/or proximity sensors. If the sensors detect a condition that indicates that it is not safe to operate the wheelchair 10 in the elevated motion mode, the controller may operate the wheelchair 10 in some other mode such as the elevated inhibited mode or standard mode (that is, by requiring the seat 12 to be in the lowermost position). In certain instances, for example, the wheelchair 10 will not operate in the elevated motion modes, i.e., the seat 12 will not move into the raised position if the seat 12 is initially in the lowered position and the wheelchair 10 is ascending an obstacle or descending down an incline.

Arm assembly 22 may have a variety of different ranges of motion depending on the state of wheelchair 10. The range of rotation as used herein refers to rotation of the arm assembly 22 to a position that is different than a first position (e.g., the position illustrated in FIG. 5A). When the arm assembly 22 is in the first position, such that the wheelchair 10 is operating on flat, level ground G, a first, fixed reference line L intersects the pivot axis $A_4$ and the front wheel axis $A_2$. The line L defines an angle $\alpha$ from the ground surface G in the first position. In one embodiment, the angle $\alpha$ is approximately 5 degrees. In other embodiments, the angle $\alpha$ may be approximately 4 degrees, 3 degrees, 2 degrees, or 1 degree. Referring to FIG. 5B, the arm assembly 22 may have a first range of motion relative to frame 16 in the disengaged position such that reference line L is movable up to an angle $\beta_1$ relative to the ground surface G. In one embodiment, the angle $\beta_1$ is approximately 15 degrees. In other embodiment, the angle $\beta 1$ may be approximately 14 degrees, 13 degrees, 12 degrees, 11 degrees, 10 degrees or 9 degrees. Referring to FIG. 6B, the arm assembly 22 may have a second range of motion relative to frame 16 in the engaged position such that reference line L is movable up to an angle $\beta_2$ relative to the ground surface G, the angle $\beta_2$ being less than angle $\beta_1$. In one embodiment, the angle $\beta_2$ is approximately 10 degrees. In other embodiments, the angle $\beta_2$, may be approximately 14 degrees, 13 degrees, 12 degrees, 11 degrees, 10 degrees, 9 degrees, 8 degrees, 7 degrees or 6 degrees. In one embodiment, the angle $\beta_1$ is approximately ⅔rds of angle $\beta_2$. In one embodiment, the angle $\beta_1$ is less than approximately ⅔rds of angle $\beta_2$. In one embodiment, angle $\beta_2$ is approximately ⅔ the value of angle $\beta_1$ In one embodiment, the bottom of the front wheel 26 lifts no more than approximately 1.5" off ground Gin the engaged position. In one embodiment, the bottom of the front wheel 26 lifts no more than approximately 1.25" off ground G in the engaged position. In one embodiment, the bottom of the front wheel 26 lifts no more than approximately 1" off ground G in the engaged position. In one embodiment, the bottom of the front wheel 26 lifts no more than approximately 0.75" off ground G in the engaged position.

The arm limiter 46 may be disengaged when the wheelchair 10 is operating in the standard motion mode, i.e., when the seat 12 is in the lowered position. When the controller receives an input from the input device to operate the wheelchair 10 in the elevated motion mode, the controller may causes the arm limiter to transition into the second or engaged configuration. However, if certain conditions are not met, the arm limiter 46 may be inhibited from moving into the engaged position. For example, the arm limiter 46 may be able to move into the engaged position only when the front wheel 26 and drive wheel 18 are on flat, level ground G (or substantial flat, level ground). If the front wheel 26 is on a surface that is raised relative to the drive wheel 18 and to ground surface G such that the arm assembly 22 is pivoted vertically as shown in FIG. 5B, then the arm limiter 46 is physically blocked from moving into the engaged position (e.g., the catch 34*b* has already passed the first notch 46*a*. If the front wheel 26 then returns to the ground plane G, biasing or tension spring 48 may cause the arm limiter 46 to move to the engaged position. If the lift mechanism 30 is lowered while the front wheel 26 is on a raised surface relative to ground plane G, trigger 30*d* may cause the arm limiter 46 to rotate about its axis $A_6$ and allow arm 22 to rotate beyond the raised angle limit without causing undue stress or damage to components of the wheelchair 10.

In one embodiment, wheelchair 10 includes a suspension means for controlling motion of arm assembly 22 relative to frame 16 depending upon a configuration of arm limiter 46 (e.g., depending upon whether the arm limiter is in the engaged position or not in the engaged position). In one embodiment, the suspension means includes a first suspension component such as traction member 36 and/or a second suspension component such as obstacle suspension 38 (illustrated for example in FIG. 4A). In one embodiment, the first suspension component has a first range of travel and the second suspension component has a second range of travel that is less than the first range of travel. The suspension may be configured such that the first range of travel is only achieved (e.g., when the first suspension component is fully compressed) when the arm limiter is not in the engaged position. The suspension means may also be configured such that the second range of travel is only achieved (e.g., when the second suspension component is fully compressed) when the arm limiter is in the engaged position. In one embodiment, arm limiter 22, the second suspension component (e.g., obstacle suspension 38) and the first suspension component (e.g., traction member 36) are coupled (e.g., each being rotatably coupled) to wheelchair 10 at a common axis (e.g., axis A6 illustrated, for example, in FIG. 4A).

In one embodiment, the adjustable height wheelchair 10 includes one or more computers (e.g., a controller) having one or more processors and memory (e.g., one or more nonvolatile storage devices). In some embodiments, memory or computer readable storage medium of memory stores programs, modules and data structures, or a subset thereof for a processor to control and run the various systems and methods disclosed herein. In one embodiment, a non-transitory computer readable storage medium having stored thereon computer-executable instructions which, when executed by a processor, perform one or more of the methods disclosed herein.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a," "an" and "the" are not limited to one element but instead should be read as meaning "at least one."

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

We claim:

1. A powered wheelchair comprising:

a frame;

an arm assembly including an arm that is pivotably coupled to the frame, the arm assembly including a wheel coupled to the arm;

a suspension coupled to the frame and to the arm assembly, the suspension configured to resist pivoting of the arm assembly relative to the frame;

a drive system coupled to the arm assembly and configured to drive a drive wheel;

an arm limiter pivotably coupled to the suspension and coupled to one or more of the arm assembly and the drive system in an engaged position, the arm limiter being configured to limit movement of the arm assembly in the engaged position; and an expandable traction member coupled to one or more of the arm assembly and the drive system and to the frame, wherein the arm assembly includes a catch, and the arm limiter is coupled to the catch in the engaged position.

2. The powered wheelchair of claim 1, wherein the arm limiter includes a latch arm, the latch arm having a notch for engaging the catch.

3. The powered wheelchair of claim 2, wherein the latch arm is bent generally in the shape of a question mark.

4. The powered wheelchair of claim 3, wherein the arm limiter includes a spring coupled between the latch arm and the suspension, the spring being configured to bias the latch arm toward the engaged position.

5. The powered wheelchair of claim 4, wherein the latch arm includes a free distal end configured to engage with a projection extending from a lift mechanism of the powered wheelchair.

6. The powered wheelchair of claim 1, wherein the expandable traction member is configured to bias the arm assembly upwardly relative to a ground surface.

7. The powered wheelchair of claim 1, wherein the arm limiter is pivotably coupled to the suspension proximate where the expandable traction member is coupled to the frame.

8. The powered wheelchair of claim 1 further comprising:
a lift mechanism supported by the frame; and
a seat supported by the lift mechanism, the lift mechanism configured to move the seat between a lowered position and a raised position.

9. The powered wheelchair of claim 8, wherein the lift mechanism includes a projection configured to engage the arm limiter in the lowered position and release the arm limiter in the raised position and allow the arm limiter to transition to the engaged position.

10. The powered wheelchair of claim 1, wherein the suspension includes a lever pivotably coupled to the frame and a compression spring coupled between the frame and the lever, the arm limiter being pivotably coupled to the lever.

11. The powered wheelchair of claim 1, wherein the arm limiter is prevented from transitioning to the engaged position depending on the position of the arm assembly.

12. The powered wheelchair of claim 1, wherein the drive system includes an electric motor and a gearbox.

13. The powered wheelchair of claim 1, wherein the drive system is rigidly coupled o the arm assembly and indirectly coupled to the frame by the arm assembly.

14. The powered wheelchair of claim 1, wherein the arm limiter includes a sensor, the drive system being configured to drive the drive wheel at a reduced speed when the sensor detects that the arm limiter is in the engaged position.

15. A powered wheelchair comprising:
a frame;
a lift mechanism supported by the frame;
a seat supported by the lift mechanism, the lift mechanism configured to move the seat between a lowered position and a raised position;
a pair of drive wheels;
at least one drive coupled to the frame and configured to apply a torque to at least one of the drive wheels;
an arm assembly including an arm that is pivotably coupled to the frame and a wheel coupled to the arm, the arm configured to be in a first position relative to the frame when the powered wheelchair is operating on flat ground and to be rotatable from that first position, the arm assembly having a suspension coupled to the frame;
an arm limiter configured to inhibit motion of the arm when the seat is in the raised position, the arm limiter having a first configuration in which the arm is rotatable from the first position through a first range of rotation, and a second configuration in which the arm is rotatable from the first position only through a second range of rotation that is smaller than the first range of rotation, the arm limiter coupled to the suspension and configured to engage the arm assembly in the second configuration; and
a trigger mounted to the lift mechanism and coupled with the arm limiter such that as the seat is moved between the lowered and raised positions, the trigger causes the arm limiter to transition between the first and second configurations,
wherein the arm limiter is prevented from transitioning into the second configuration when the arm is rotationally different from the first position relative to the frame by more than a predetermined amount.

16. The powered wheelchair of claim 15, wherein the trigger is configured to urge the arm limiter toward the first configuration as the lift mechanism moves the seat from the raised position to the lowered position.

17. The powered wheelchair of claim 15, wherein the predetermined amount is greater than or equal to 4 degrees.

18. The powered wheelchair of claim 15, wherein the trigger includes a projection projecting laterally from a side of the lift mechanism.

19. The powered wheelchair of claim 15, wherein the suspension comprises a first suspension component having a first range of travel and a second suspension component having a second range of travel that is less than the first range of travel and wherein the second suspension component is configured to move through the second range of travel during operation of the powered wheelchair only when the arm limiter is in a second position.

20. The powered wheelchair of claim 19, wherein the first suspension component is configured to compress an amount that is less than the first range of travel when the arm limiter is in the second position.

21. The powered wheelchair of claim 19, wherein the second suspension component is configured to compress through the entire second range of travel when the arm limiter is in the second position.

22. A powered wheelchair comprising:
a frame;
a lift mechanism supported by the frame;
a seat supported by the lift mechanism, the lift mechanism configured to move the seat between a lowered position and a raised position;
a pair of drive wheels;
at least one drive coupled to the frame and configured to apply a torque to at least one of the drive wheels;
an arm limiter;
an arm assembly including an arm that is pivotably coupled to the frame and a wheel coupled to the arm, the arm configured to be in a first position relative to the frame when the powered wheelchair is operating on flat ground and to be rotatable from that first position, the arm assembly having a suspension configured to control motion of the arm assembly relative to the frame depending upon a configuration of the arm limiter,
the arm limiter configured to inhibit motion of the arm when the lift mechanism is in the raised position, the arm limiter having a first configuration in which the arm assembly is rotatable from the first position through a first range of rotation, and a second configuration in which the arm is rotatable from the first position only through a second range of rotation that is smaller than the first range of rotation, the arm limiter coupled to the suspension and configured to engage the arm assembly in the second configuration; and
a trigger mounted to the lift mechanism and coupled with the arm limiter such that as the seat is moved between the lowered and raised positions, the trigger causes the arm limiter to transition between the first and second configurations,
wherein the arm limiter is prevented from transitioning into the second configuration when the arm is rotationally different from the first position relative to the frame by more than a predetermined amount.

23. The powered wheelchair of claim 22 wherein the suspension comprises a first suspension component having a first range of travel and a second suspension component having a second range of travel wherein the first suspension component is compressible through the first range of travel when the arm limiter is not in the engaged position and the second suspension component is compressible through the second range of travel when the arm limiter is in the engaged position.

24. The powered wheelchair of claim 22 wherein the suspension is a suspension means for controlling motion of the arm assembly relative to the frame depending upon a configuration of an arm limiter.

* * * * *